United States Patent [19]

LaBarge et al.

[11] Patent Number: 4,558,775

[45] Date of Patent: Dec. 17, 1985

[54] APPARATUS FOR PASSIVE ANALYSIS OF CONTAINERS TO DETERMINE ACCEPTABILITY FOR RECYCLING

[75] Inventors: Robert L. LaBarge, Ben Avon; Eric D. Arndt, New Kensington; Jerrold D. Green, Murrysville, all of Pa.; Ronald G. Hawkins, Massena, N.Y.; Frank J. Horansky, Apollo; Charles J. Leftault, Jr., Murrysville, both of Pa.; Elmer E. Pohlenz, Richmond, Ind.; Thomas W. Scherf, Vandergrift, Pa.

[73] Assignee: Aluminum Company of America, Pittsburgh, Pa.

[21] Appl. No.: 559,423

[22] Filed: Dec. 8, 1983

[51] Int. Cl.[4] ..... G07F 7/06

[52] U.S. Cl. ..... 194/4 C; 100/902

[58] Field of Search ..... 194/4 C, 4 B, 4 D, 4 R, 194/4 E, 100 A; 100/902, 53

[56] References Cited

U.S. PATENT DOCUMENTS

| | | | |
|---|---|---|---|
| Re. 27,643 | 5/1973 | Myers | 194/4 C |
| 1,560,242 | 11/1925 | Jones et al. . | |
| 1,791,078 | 2/1931 | Fitch . | |
| 1,809,693 | 6/1931 | Hahling . | |
| 1,922,253 | 8/1933 | McCormick et al. | 194/4 |
| 2,354,349 | 7/1944 | Polsen et al. | 100/4 |
| 2,800,159 | 7/1957 | Walsh et al. | 153/10.5 |
| 2,887,204 | 5/1959 | Giuliano | 194/4 |
| 2,908,440 | 10/1959 | Gurewitz | 235/98 |
| 3,039,583 | 6/1962 | Menefee | 194/4 |
| 3,095,806 | 7/1963 | Mirkovich | 100/173 |
| 3,159,259 | 12/1964 | Reece | 194/4 |
| 3,315,594 | 4/1967 | Simshauser | 100/52 |
| 3,371,781 | 3/1968 | Armbruster et al. | 209/111.8 |
| 3,380,044 | 4/1968 | Mordwinkin | 340/213 |
| 3,430,766 | 3/1969 | Stone | 209/111.7 |
| 3,489,354 | 1/1970 | Harper et al. | 241/36 |
| 3,504,621 | 4/1970 | Qualheim | 100/96 |
| 3,687,062 | 8/1972 | Frank | 100/91 |
| 3,749,004 | 7/1973 | Pagdin et al. | 100/50 |
| 3,750,877 | 8/1973 | Dvacho et al. | 209/73 |
| 3,776,128 | 12/1973 | Morris | 100/53 |
| 3,792,765 | 2/1974 | Arp | 194/4 C |
| 3,814,009 | 6/1974 | Davis, Jr. et al. | 100/159 |
| 3,827,351 | 8/1974 | Rosenow | 100/176 |
| 3,907,087 | 9/1975 | Tanaka | 194/4 C |
| 3,916,780 | 11/1975 | Heiser | 100/49 |
| 3,951,059 | 4/1976 | Morris | 100/173 |
| 4,059,050 | 11/1977 | Davis, Jr. | 100/91 |
| 4,059,795 | 11/1977 | Mordwinkin | 324/233 |
| 4,091,725 | 5/1978 | Arp | 100/45 |
| 4,179,018 | 12/1979 | Miller | 194/4 R |
| 4,230,987 | 10/1980 | Mordwinkin | 324/236 |
| 4,248,334 | 2/1981 | Hanley et al. | 194/4 C |
| 4,248,389 | 2/1981 | Thompson et al. | 241/101.5 |
| 4,253,573 | 3/1981 | Dubberly et al. | 209/525 |
| 4,261,259 | 4/1981 | Beardslee | 100/152 |
| 4,265,170 | 5/1981 | Schulze, Jr. | 100/49 |
| 4,285,426 | 8/1981 | Cahill | 194/4 C |
| 4,291,618 | 9/1981 | Heiser et al. | 100/35 |
| 4,316,410 | 2/1982 | Davis, Jr. | 100/48 |
| 4,342,385 | 8/1982 | Kaspar | 194/4 D |
| 4,345,679 | 8/1982 | DeWoolfson | 194/4 C |

*Primary Examiner*—Stanley H. Tollberg

*Attorney, Agent, or Firm*—Andrew Alexander; John P. Taylor

[57] ABSTRACT

An apparatus for the receipt of a recyclable container is disclosed. The apparatus includes a manually rotatable carrier having a container receiving station. The recyclable container is inserted into the receiving station where the presence or absence of a container having a metallic sidewall is determined prior to any movement apparent to the user. If the object inserted into the receiving station is determined to be a container having a metallic sidewall, rotation of the carrier for further processing of the recyclable container is permitted. The initial passive screening may include detecting the orientation of the container, detection for the type of metal sidewall, and may also include optical scanning of the container for reading a product code thereon.

3 Claims, 52 Drawing Figures

FIGURE 1a
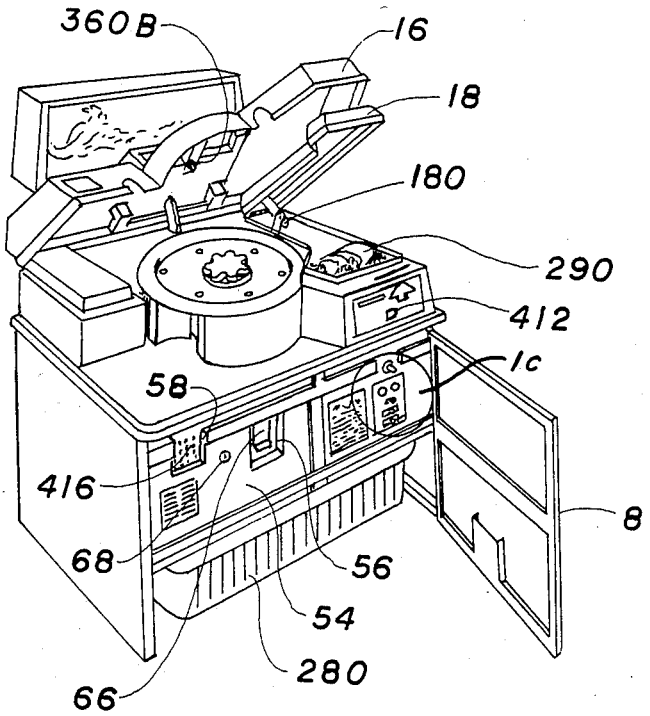
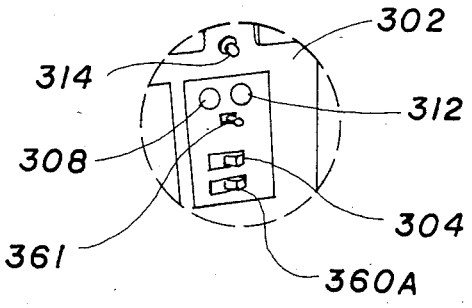
FIGURE 1c

FIGURE 5a
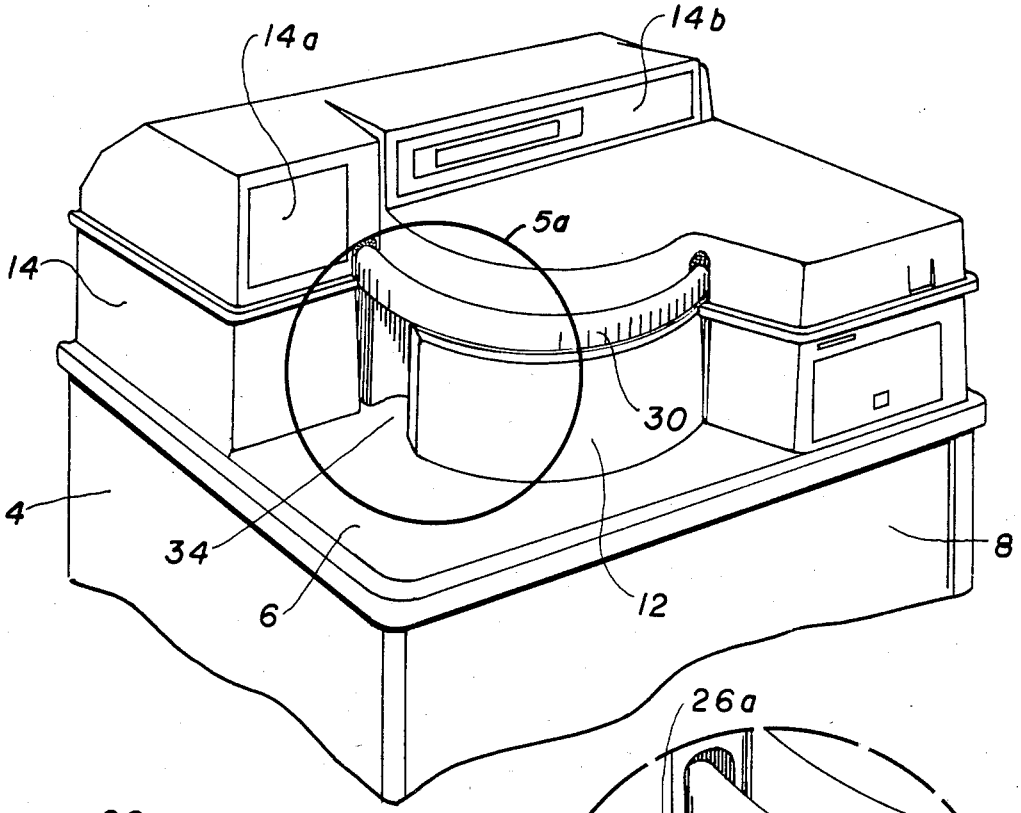
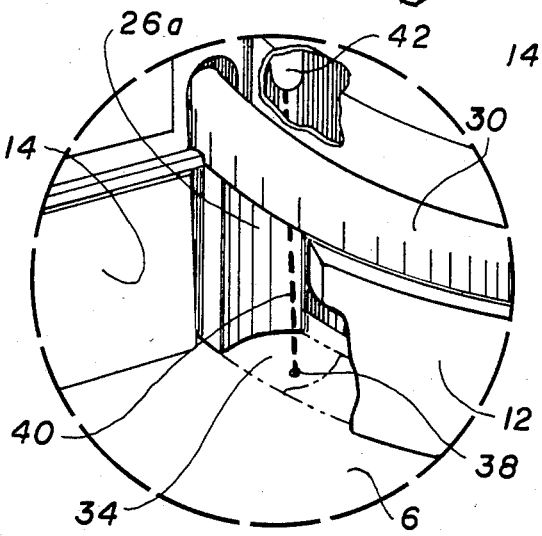
FIGURE 5
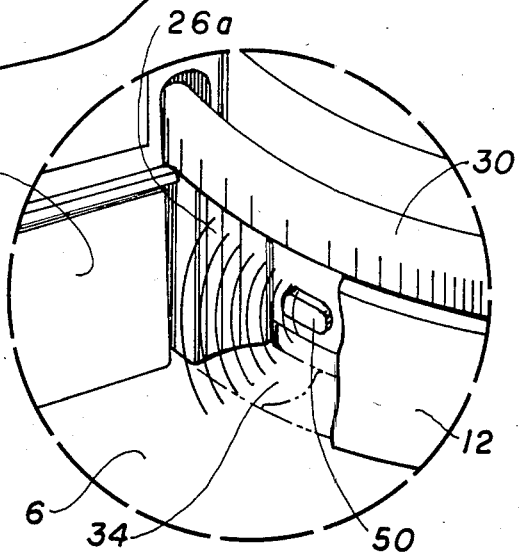
FIGURE 6

FIGURE 7b
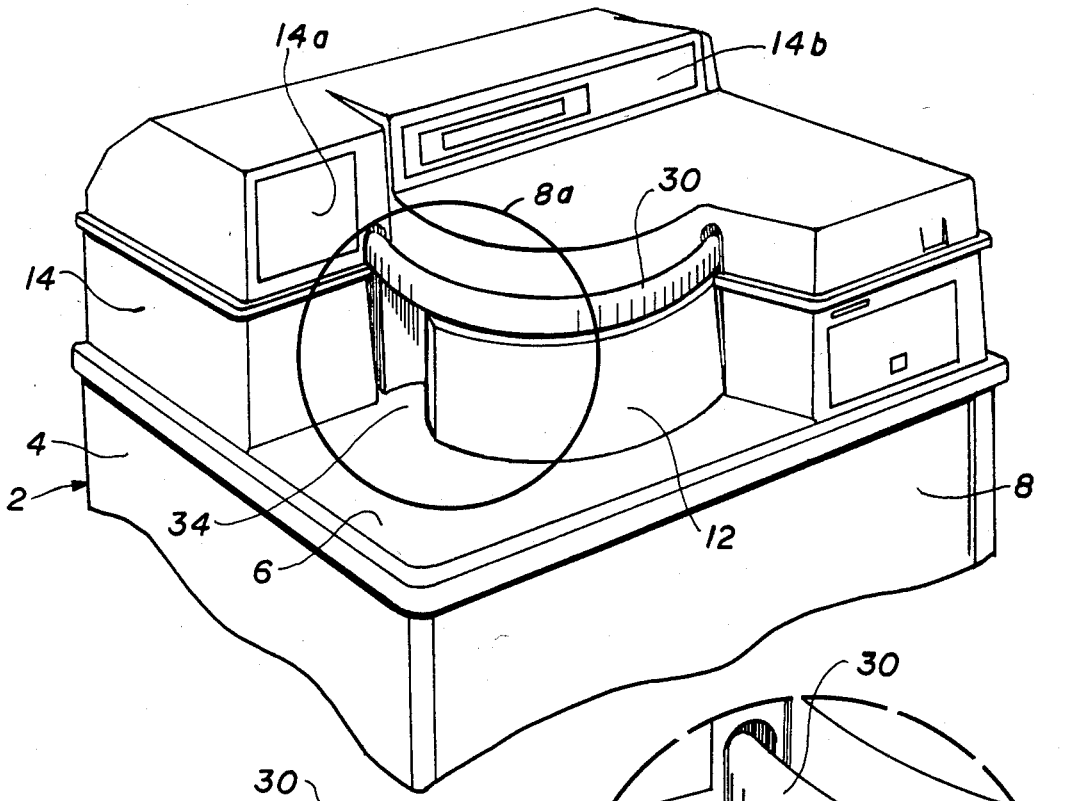
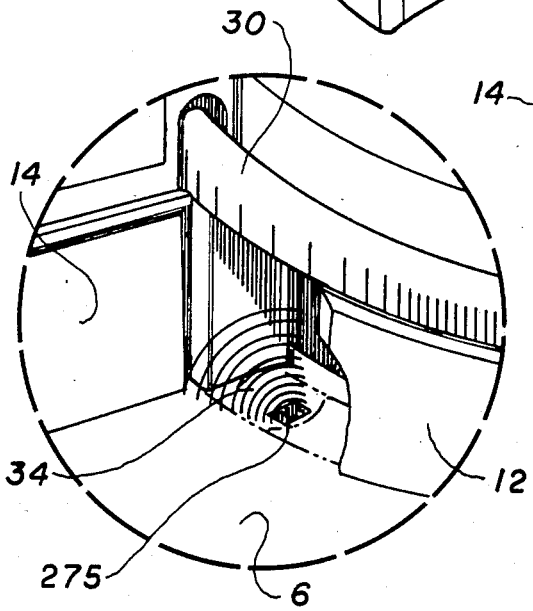
FIGURE 8
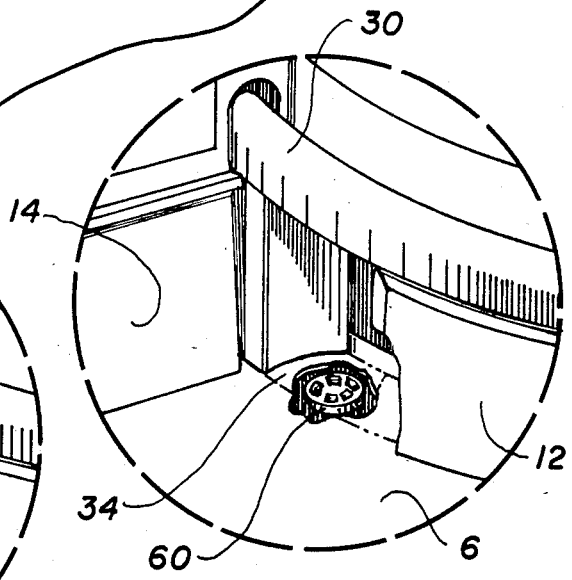
FIGURE 7

FIGURE 8c
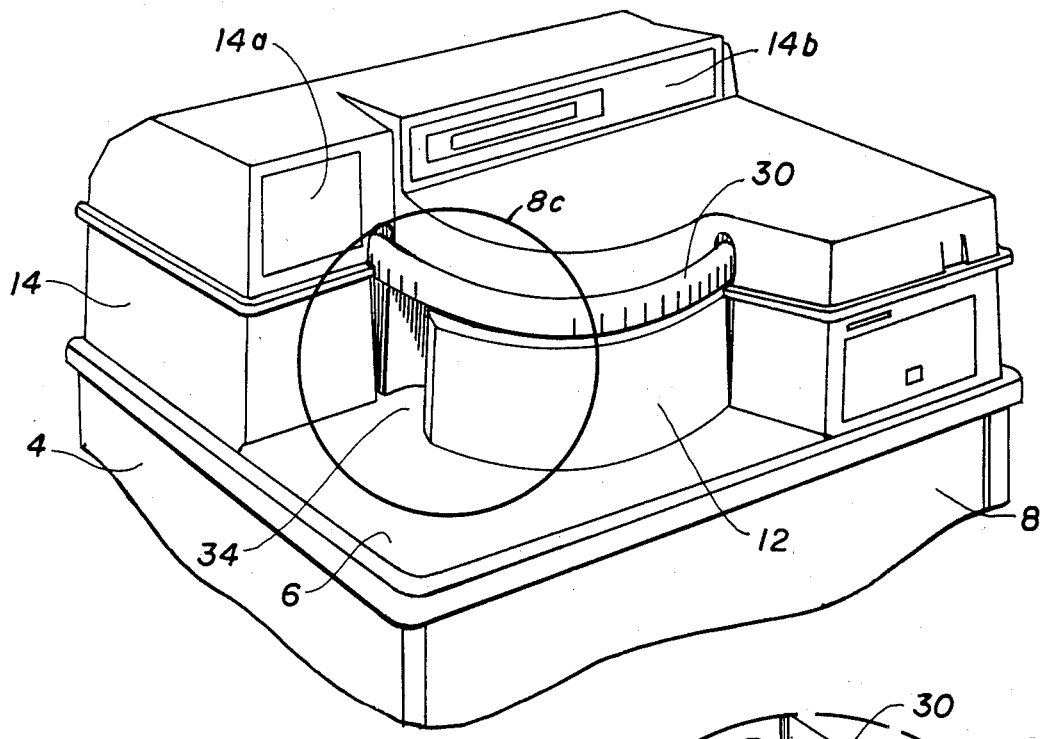
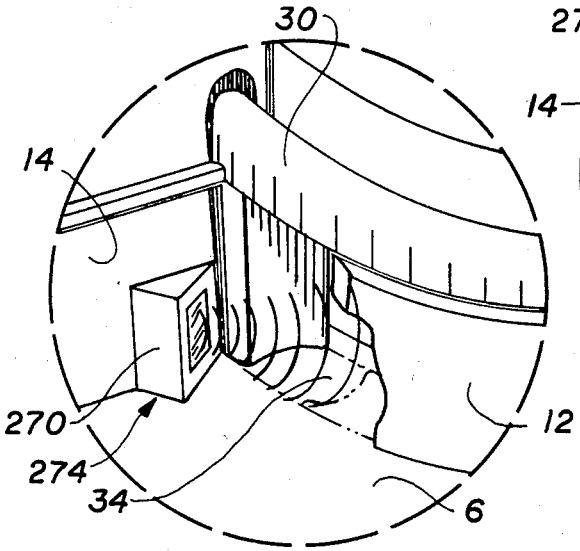
FIGURE 8a
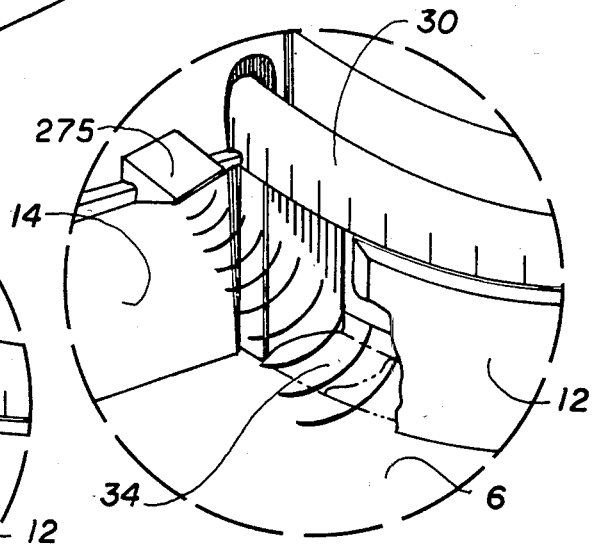
FIGURE 8b

POWER FAILURE LOGIC

APPARATUS FOR PASSIVE ANALYSIS OF CONTAINERS TO DETERMINE ACCEPTABILITY FOR RECYCLING

BACKGROUND OF THE INVENTION

1. Field of the Art

This invention relates to apparatus for receiving and crushing empty metal containers such as aluminum beverage food cans or containers and dispensing a refund for the cans.

2. Brief Description of the Prior Art

Recycling of aluminum, as in aluminum cans, is a vital energy saver, is a supplemental source of raw material, and helps turn the problem of litter into economic opportunities. Recycling conserves large quantities of energy since producing new aluminum from used aluminum beverage cans saves 95% of the energy required to produce molten aluminum from original ore. It also conserves much-needed capital and precious raw materials. A facility to process recycled aluminum can be built for one-tenth of the cost and half the time of new aluminum refining and smelting capacity. Recycled containers have also become an economical source of metal which reduces our dependence on foreign imports.

Recycling of empty aluminum beverage cans continues to set new records, but billions of cans are still discarded in land fills or other waste repositories. At present, about 50% of the aluminum beverage cans are recycled. Since there are approximately 1.4 billion pounds of aluminum cans used each year, this means that about 700 million pounds of aluminum cans are not recycled.

In order to promote recycling of cans, the process must be made more convenient for the consumer. Improved convenience requires the addition of many collection centers at closely spaced locations, supermarkets or grocery stores or retail outlets such as convenience stores, for example. This minimizes travel time, itself a conserver of gasoline, in returning cans to collection centers. Generally, consumers are increasingly unwilling to make a special trip of some distance to return a few pounds of aluminum cans. A typical full-scale collection center, which requires at least one full-time attendant, must receive large quantities of cans in order to make the collection process economical. Such centers are, therefore, located to be accessible to large population concentrations and are not convenient to many people for return if small quantities of cans.

Increasing the number of collection centers for cans requires automation of the collection process. Accordingly, it is desirable to provide machines which are adapted to receive empty cans and automatically dispense a refund for the cans without the need for a full-time operator or attendant at the machine.

Machines for receiving empty bottles and dispensing refunds for such bottles have been well known for many years. For example, U.S. Pat. Nos. 1,560,242; 1,791,078; 1,809,693; 1,866,719; 1,897,072; 1,922,253; and 1,987,835 all disclose vending machines which both dispense filled bottles and receive empty bottles for which a refund as a coin or coupon is given.

Machines for receiving empty metal cans and dispensing a refund for the cans are also known as disclosed by several United States patents. For example, U.S. Pat. No. Re. 27,643 to Meyers discloses an apparatus for collecting metallic containers, crushing the containers and dispensing a token for nonmagnetic metallic containers. U.S. Pat. Nos. 3,792,765; 3,857,334; 4,091,725; and 4,141,493 to Arp are all addressed to apparatus for dispensing tokens for empty cans returned to the apparatus. Arp's machines include sensing devices for determining whether the cans are of a given size, weight and design for payment of a token for the cans. The machines also include crushing rams or platens to flatten the cans which reduces their volume for storage in the apparatus.

U.S. Pat. No. 3,907,087 to Ianaka also discloses a machine for discharging refund coins in response to receiving metallic cans of different sizes, the can being crushed in the machine for storage purposes. The machine includes microswitch means for selectively limiting the distance of the forward stroke of a reciprocating pressure plate to permit accommodation of large and small sized cans in their respective crushable positions.

Although several machines are known for receiving, crushing and dispensing a refund for empty metallic beverage cans, an improved machine is desired which (1) is small, quiet and attractive enough to be placed inside a supermarket, (2) is highly fraud-resistant, (3) is safe for use by women and children, (4) does not malfunction from spillage of residue beverage in the cans, (5) accepts designated containers, and (6) requires a minimum of service.

SUMMARY OF THE INVENTION

It is an object of the invention to provide apparatus for the receipt of a recyclable container where in a recyclable container may be inserted by the user and analyzed for acceptable material content prior to any movement ascertainable by the user.

It is another object of the invention to provide apparatus for the receipt of a recyclable container wherein a manually operated rotatable carrier is used for the receipt and testing for acceptance of recyclable containers.

It is a further object of the invention to provide apparatus for the receipt of a recyclable container which comprises a container receiving station with means therein for detecting the presence of a container.

It is yet a further object of the invention to provide apparatus for the receipt of a recyclable container comprising a container receiving station having means for detecting the presence of a container having a metallic sidewall.

It is a still further object of the invention to provide apparatus for the receipt of a recyclable container having a container receiving station wherein detection means determine whether the container is inserted right side up.

These and other objects of the invention will be apparent from the following description and accompanying drawing.

In accordance with the invention, apparatus is provided for the receipt of recyclable containers characterized by the analysis and initial acceptance or rejection of a container for recycling without mechanical movement apparent to the user. The apparatus comprises a manually operated rotatable carrier, a container receiving station associated with the carrier, detecting means coupled to the receiving station to determine the presence of a container comprised of material acceptable for recycling, and means for subsequently permitting manual actuation of said rotatable carrier if said container comprises a material acceptable for recycling.

BRIEF DESCRIPTION OF THE DRAWINGS

FIG. 1*a* is an isometric view of the apparatus similar to FIG. 1 with both the top panel and the front access panel in an open position.

FIG. 1*c* is an exploded view of breaker, reversing, and interlock switches.

FIG. 5 is a partially cutaway view of a portion of FIG. 1 illustrating the position of the photocell and light beam in the container station.

FIG. 5*a* shows exploded view area of FIG. 5.

FIG. 6 is a partially cutaway view of a portion of FIG. 1 showing the location of the sidewall detector.

FIG. 7 is a portion of FIG. 1 cutaway to show the position of the bottom wall detector.

FIG. 7*b* shows exploded view area of FIG. 8.

FIG. 8 is a cutaway portion of FIG. 1 showing the location of the Universal Product Code detector.

FIG. 8*a* is a cutaway portion of FIG. 1 showing another location of a code detector.

FIG. 8*b* is yet a further cutaway portion of FIG. 1 showing another location of a code detector.

FIG. 8*c* shows exploded view area of FIG. 8*a*.

DETAILED DESCRIPTION OF THE INVENTION

Figure 1:
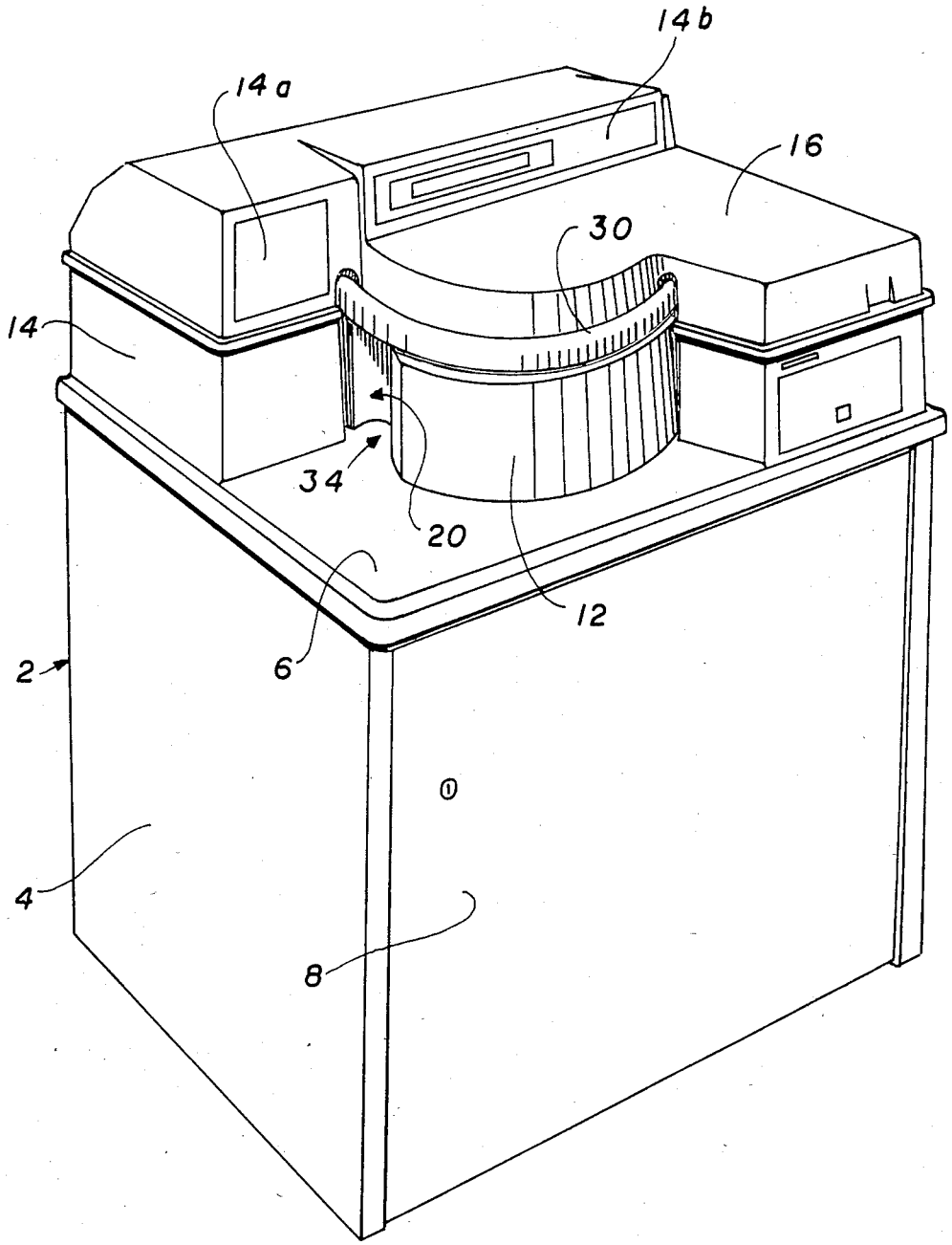
FIG. 1 is an isometric view of the apparatus of the invention.

Referring now to FIG. 1, the recycling apparatus generally indicated at 2 comprises an enclosure 4 having a top surface 6 and a front access panel 8 which may conveniently be hinged to permit easy access to crushed containers stored in the apparatus.

Still referring to FIG. 1, as well as FIGS. 1*a*, 1*b*, 2*a* and 2*b*, top surface 6 of enclosure 4 is provided with a hinged protective housing or shroud 14 which may be integrally molded to surface 6 as in the drawing or may comprise a removable member. Protective housing 14 includes a circular cutaway portion into which a carousel unit 20 fits and which provides a housing around approximately 270° of the carousel unit. A hinged top shroud or cover member 16 on housing 14 permits access to carousel 20. A front guard member 12 attached to housing 14 is mounted in front of carousel 20 to shield all but a portion of carousel 20 which defines a container receiving station 34. Display panels 14*a* and 14*b* on the front surfaces of housing 14 contain indicia lights which indicate instructions to the user, as will be described below.

Figure 1B:
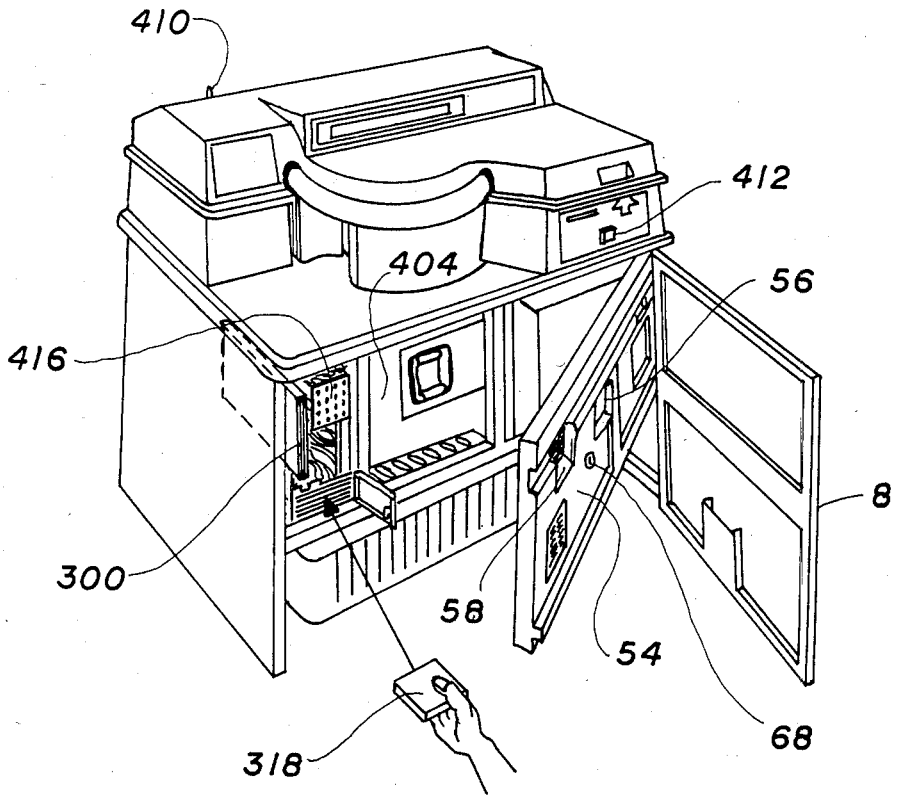
FIG. 1*b* is an isometric view of the apparatus similar to FIG. 1 with both the front panel and a security panel behind the front panel in an open position.

Referring particularly to FIG. 1*a*, front access panel or door 8 is shown in an open position which permits accessibility to crushed container bin 280 as well as a hinged security panel or door 54 which houses some of the electrical controls as well as providing security against unauthorized tampering with other electrical controls provided on a control panel 404 behind door 54, as more clearly shown in FIG. 1*b*.

Mounted to security door 54 is an AC control panel or module 302 containing a main power breaker switch 304, a main power indicator light 308, a door interlock switch 360*a*, an interlock indicator light 312 and a crusher motor reversing switch 361. Located just above AC control module 302 is a safety interlock switch 314 which shuts off power to machine 2 when door 54 is opened. When the operator wishes to test the apparatus, safety interlock switch 314 may be overridden by door interlock switch 360*a*.

Security door 54 is provided with cutout portions 56 and 58 which provide access, respectively, to top shroud release cover handle 66 and keypad 416 both of which are mounted to control panel 404.

Security door 54 is provided with cutout portions 56 and 58 which provide access, respectively, to top shroud release cover handle 66 and keypad 416, both of which are mounted to control panel 404.

Security door 54 is secured in a closed and locked position by security door lock 68. When lock 68 is unlocked, door 54 may be swung open to reveal control panel 404, as shown in FIG. 1*b*. Keypad 416, which is mounted on control panel 404, communicates with a central control unit 300 which controls the operation of the machine, as will be described. Central control unit 300 is also mounted to control panel 404. Central control unit 300 is accessible only when security dock lock 68 is unlocked and security door 54 is open.

When cover 16 is raised, as shown in FIG. 1*a*, printer cover 18 may be raised to permit access to receipt mechanism or printer 290. Cover 18 may be held in a raised position by support arm 18*a* to facilitate changing of receipt paper or other servicing of printer 18.

As further shown in FIG. 1*b*, a cartridge receptacle 318 may also be provided on control panel 404 whereby cartridges containing promotional messages may be inserted for display on display panels 14*a* or 14*b*, if desired.

Figure 2:
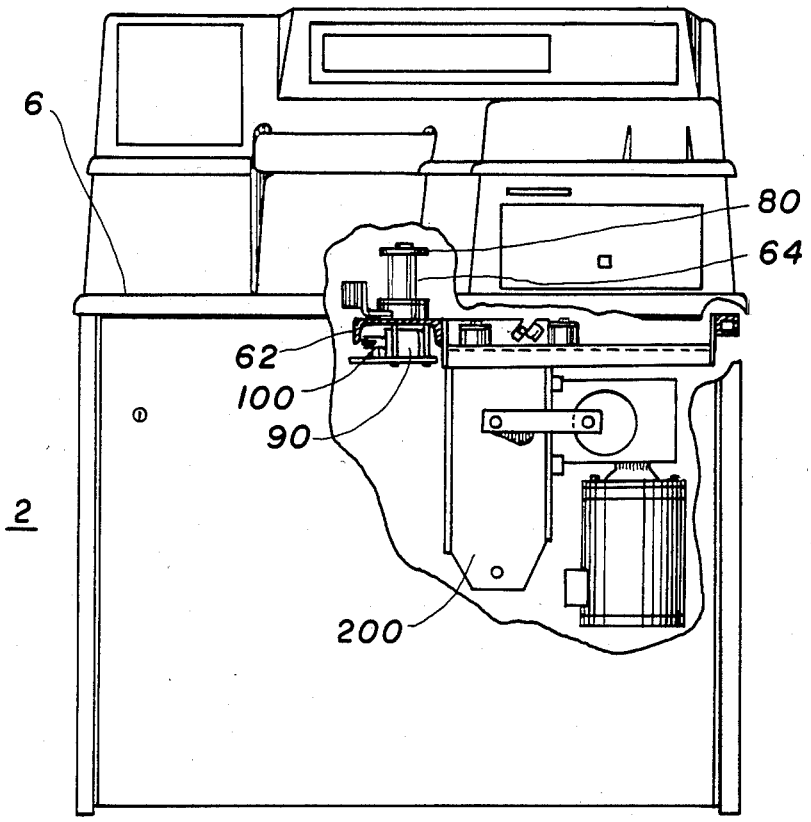
FIG. 2 is a partially cutaway front elevation view of the apparatus of FIG. 1 in perspective.
Figure 2A:
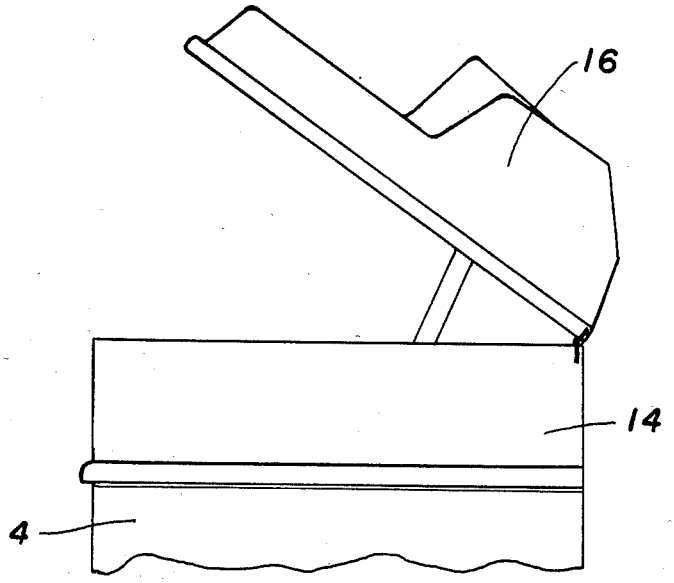
FIG. 2*a* is a side view of the apparatus of FIG. 1 showing the top shroud in a raised position.
Figure 2B:
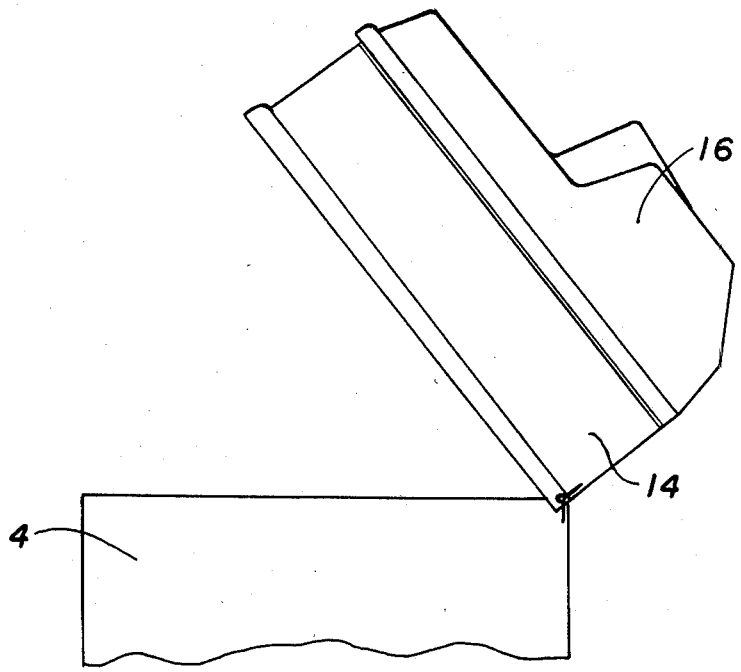
FIG. 2*b* is a side view of the apparatus of FIG. 1 showing a second shroud also in a raised position.

As shown in FIG. 2, a steel channel 62, located about bracket 90, has bolted thereto a spindle or bearing member 64. Spindle 64 receives shaft 80 (FIG. 9*a*), as will be described below.

Figure 3:
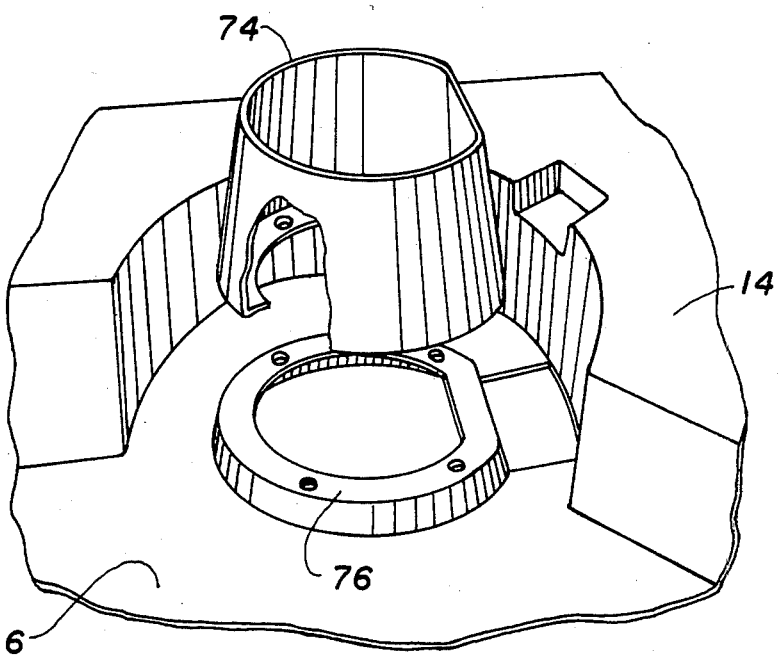
FIG. 3 is an exploded view of a portion of the apparatus of FIG. 1.
Figure 4:
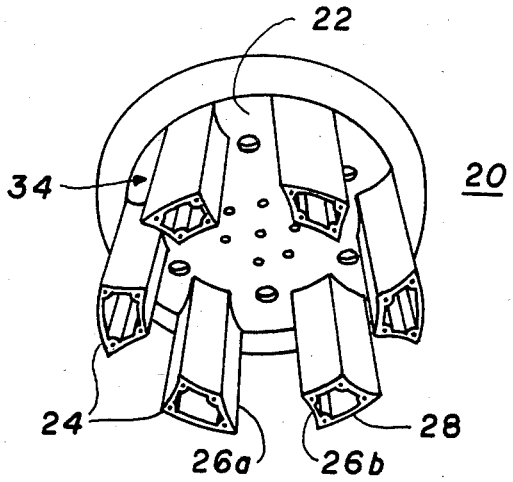
FIG. 4 is an isometric view of the carousel into which containers are inserted.

FIG. 3 illustrates a protective skirt 74 which is mounted on a flange 76 on top surface 6. Skirt 74 is mounted concentric with spindle 64 and co-operates with surfaces 26*a* and 26*b* (FIG. 4) on carousel 20 to form stations 34.

Carousel member 20 is mounted on top surface 6 of enclosure 4. As more clearly illustrated in FIG. 4, carousel member 20 comprises a circular disc or platter 22 having a series of molded members 24 depending therefrom in a circular arrangement. Each member 24 has two opposite concave surfaces 26*a* and 26*b* and an outer convex surface 28 having an arc which defines a portion of a circle when a group of members 24 are arranged in circular dependency from disc 22.

Members 24 are circularly spaced apart on disc 22 in a manner to permit concave surfaces 26*a* and 26*b* on adjoining members 24 to define a container receiving station 34 therebetween. A handwheel 30 (FIG. 5), which is mounted on top of disc 22 in a manner which will be described below, serves as a handle to permit manual rotation of carousel 20 upon insertion of a container into exposed container receiving station 34 (FIG. 5).

While receiving station is shown in a manner which will accept containers such as beverage containers in an upright manner, it will be understood that station 34 may be arranged in a horizontal manner, and containers may be placed on their sides in the station. That is, the carousel may be arranged so as to rotate about a horizontal axis instead of a vertical axis.

As illustrated in FIG. 2 and shown in detail in FIGS. 10 and 11, enclosure 4 contains a bracket 90 which is centrally mounted below top surface 6. Bracket 90, in turn, carries a latching mechanism 100 which is operationally attached to carousel 20 to control motion thereof. A bearing 102 is attached to bracket 90 and has rotationally mounted thereto a latch disc 104. Latch disc 104 contains a central slot 106 (FIG. 10) which is shaped to receive a tongue end 80*a* of a shaft 80 (FIG. 9*a*) which has flats thereon to provide a mortise and tenon or socket fit between shaft 80 and latch disc 104. A top flange 82 is mounted to the opposite end of shaft 80.

Figure 10:
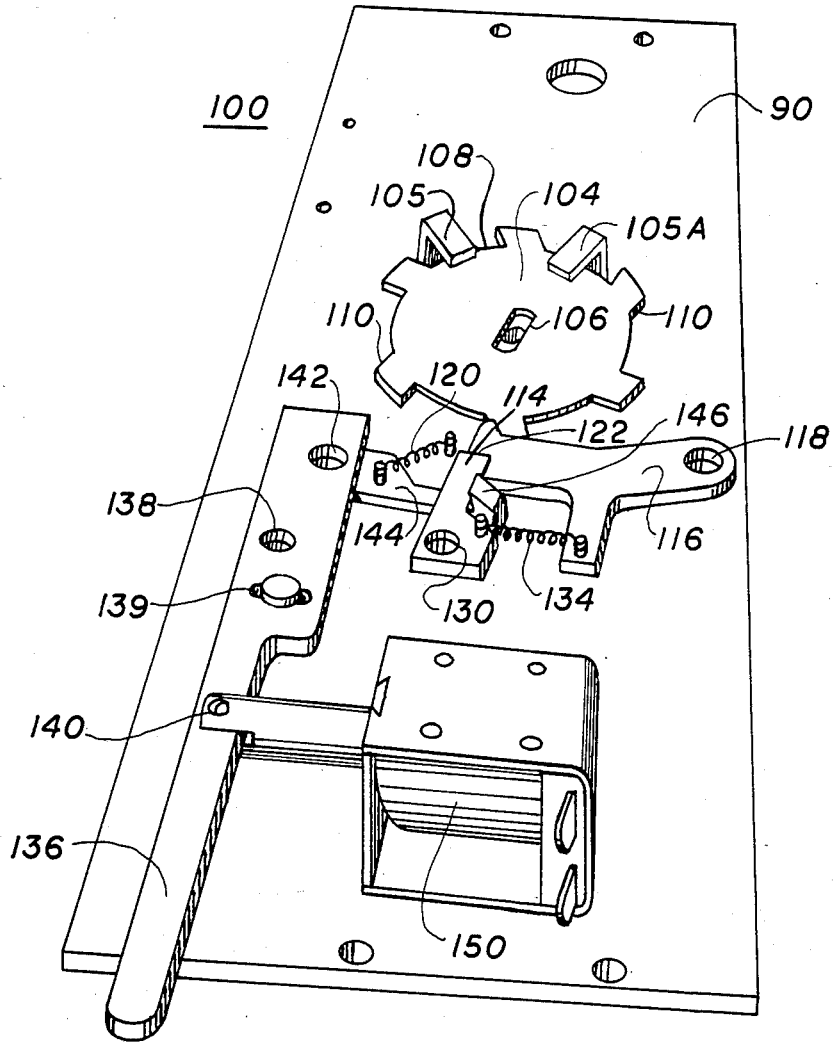
FIG. 10 is an isometric view of the latching mechanism of the apparatus of the invention in a shut or latched position.
Figure 11:
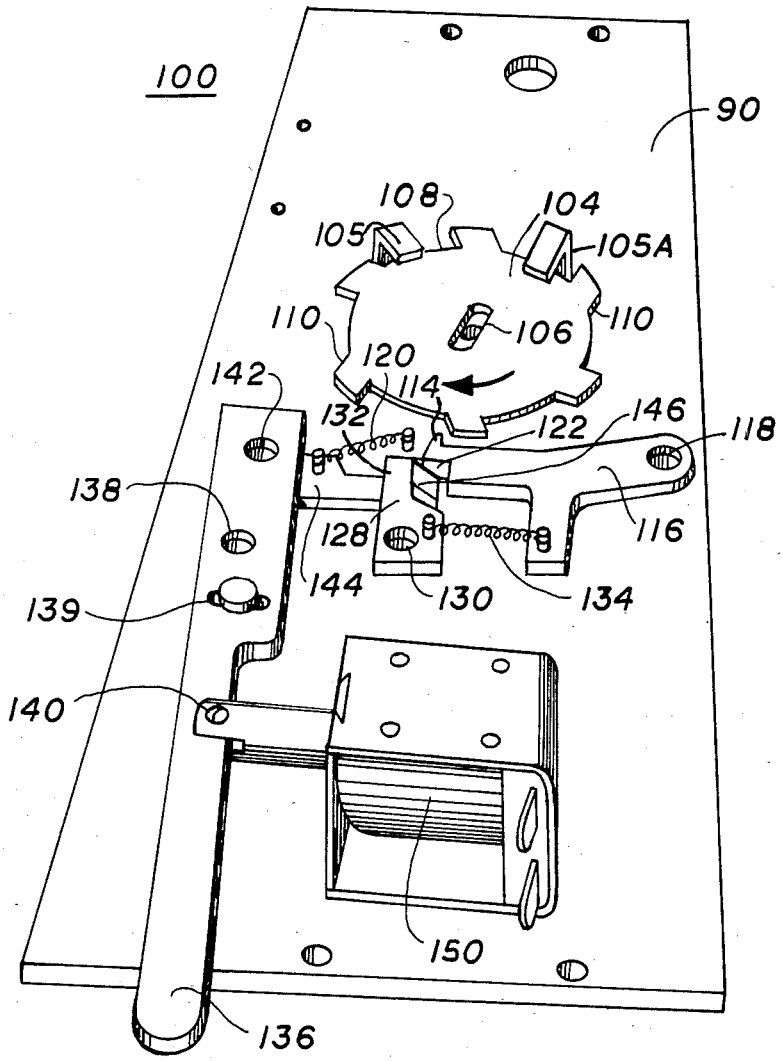
FIG. 11 is an isometric view of the latching mechanism of the invention showing the parts in an unlatched position.

As best seen in FIGS. 10 and 11, latching mechanism 100 includes a latch disc 104 which is provided with a series of notches or cammed surfaces 108 terminating respectively in shoulders 110, one of which is latchingly engaged by one end 114 of a detent lever 116 which is pivotally mounted at 118 to bracket 90. Lever end 114 is held in locking engagement with shoulder 110 on latch disc 104 by a locking lever or sear 128 which is pivotally mounted on bracket 90 at 130. End 132 of sear 128 engages a notch 122 in detent lever 116 to prevent pivoting of detent lever 116. Spring bias means 134 urges end 132 of sear 128 into engagement with notch 122 on detent lever 116.

Sear 128 is moved out of notch 122 into a release position by the action of a solenoid 150 which is activated by the detectors in station 34. A solenoid lever 136, which is pivotally mounted to bracket 90 at 138, is attached to solenoid 150 at 140. Solenoid lever 136 is, in turn, pivotally coupled at 142 to a link latch 144. Link latch 144 engages sear 128 via a hooked end 146 to disengage sear end 132 from notch 122 upon activation of solenoid 150.

With sear 128 held in an unlatched position, as shown in FIG. 11, latch disc 104 and carousel 20 may be rotated which will permit detent lever 116 to pivot out of engagement with shoulder 110 on latch disc 104. As disc 104 rotates, optical switches 105 and 105A change state from dark to light sending signals to central control unit 300 which then deenergizes solenoid 150. Spring bias means 120 then returns lever 136 and link latch 144 to the shut position. This, in turn, permits spring bias means 134 to return sear 128 into notch 122 on lever 116 to relock latch disc 104. It will be noted that 139 identifies a stop which controls the travel of lever 136. Thus, carousel 20 will only be allowed to rotate 60° to permit the next station 34 to become visible. It should be further noted that the latching and unlatching sequence as controlled by central control unit 300 is designed to permit the apparatus to function at a speed capable of accepting a container about every 8/10 of a second.

Figure 9:
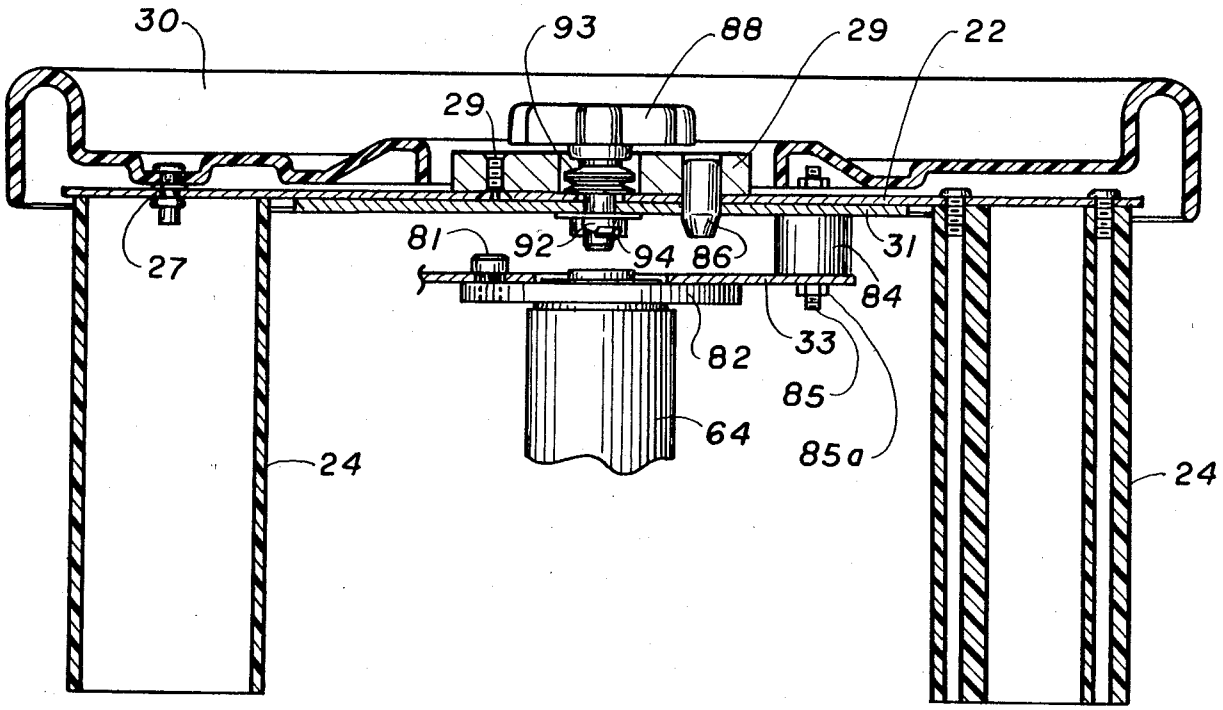
FIG. 9 is a cross-sectional view of a portion of the carousel.
Figure 9A:
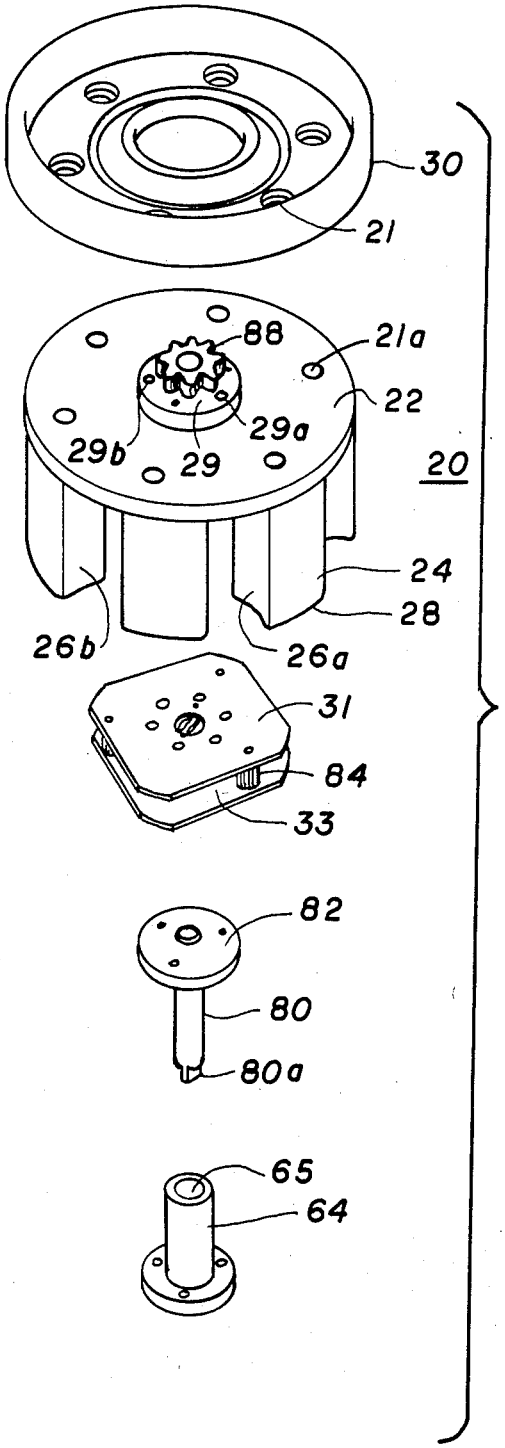
FIG. 9*a* is an exploded view of a portion of the carousel.
Figure 9B:
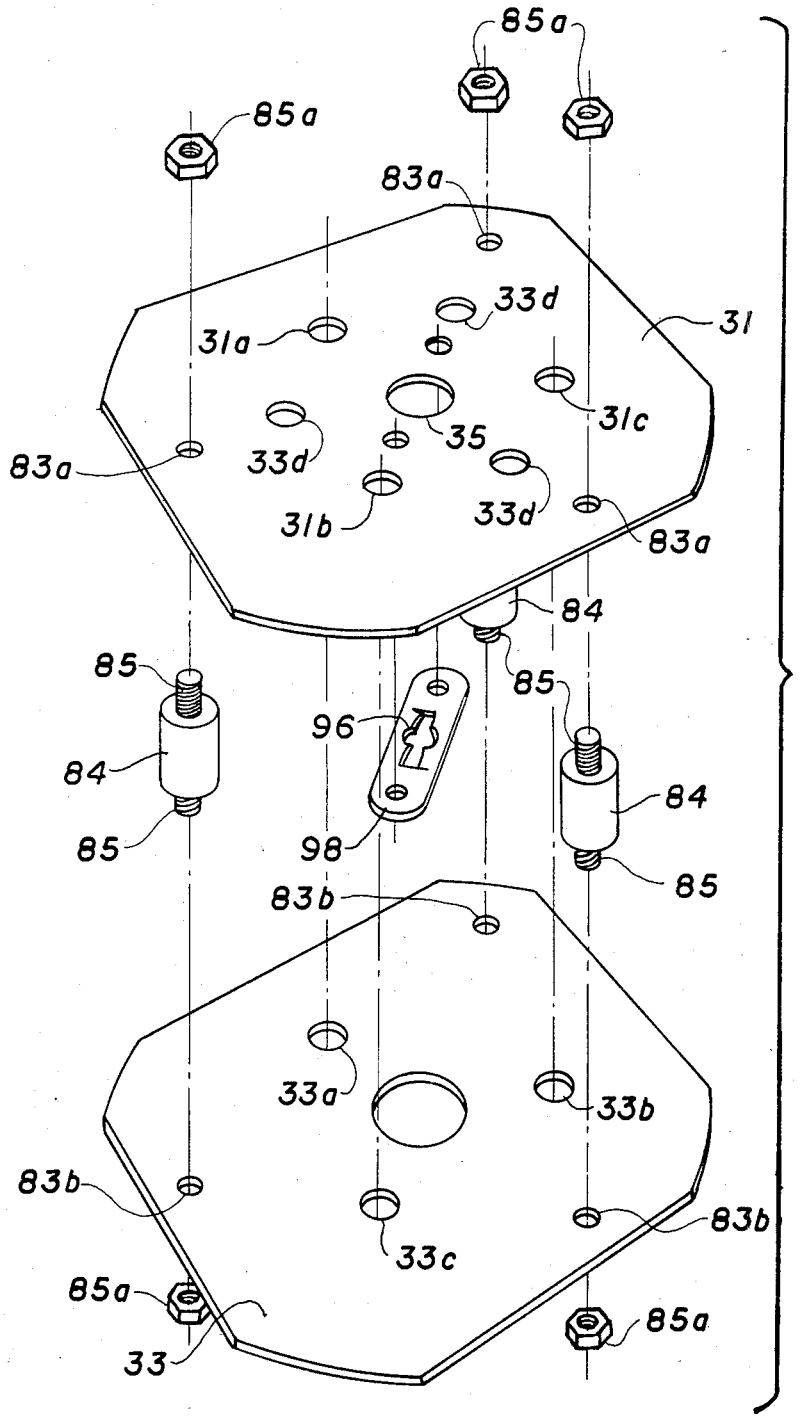
FIG. 9*b* is an exploded view of another portion of the carousel.
Figure 9C:
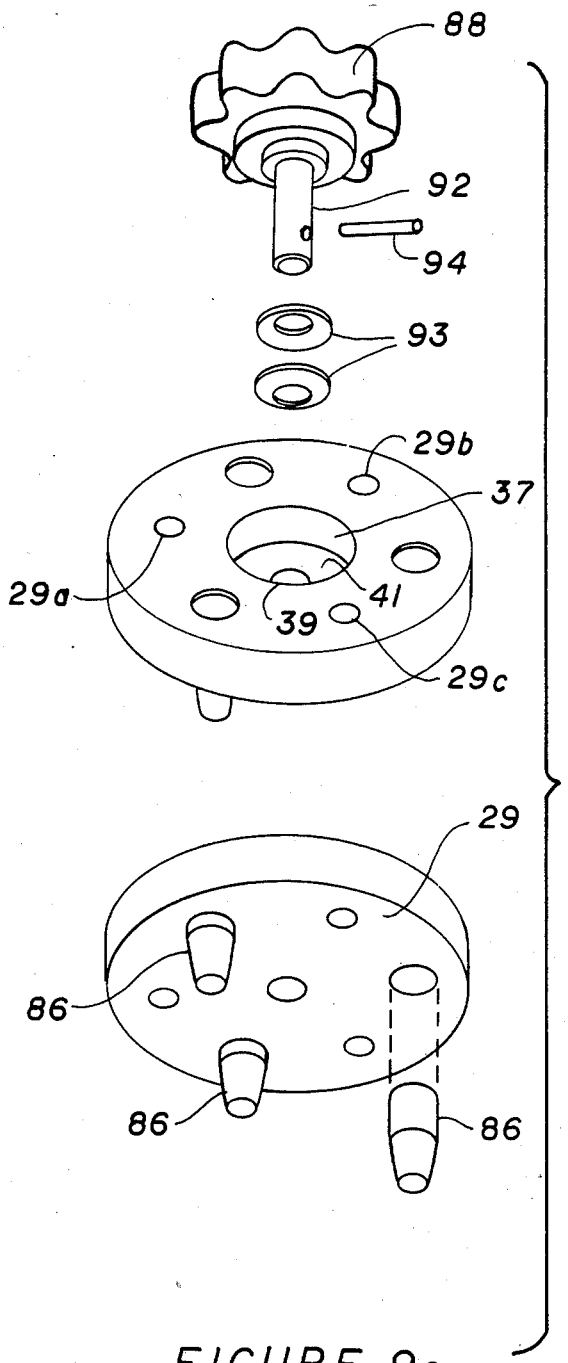
FIG. 9*c* is an exploded view of yet another portion of the carousel.

The cross-sectional view in FIG. 9, as well as the exploded views in FIGS. 9*a* through 9*c*, illustrates parts of the carousel as well as the parts utilized for connecting the carousel to the latching mechanism. Thus, referring now to FIGS. 9 and 9*a*, there is shown handwheel 30 which attaches to circular disc 29 with mechanical fasteners 27 through holes 21 and 21A, six of each being provided, respectively. Also shown in FIG. 9*a* is a central fastening knob 88 which, in cooperation with circular member 29, provides for a quick disconnect system for the carousel from the latching mechanism.

Because the latching mechanism is located under surface 6 (FIGS. 1 and 2) of the machine, it will be understood that the carousel is supported away from latching mechanism 100 by a bearing member 64 (FIG. 9*a*) which is fastened or mounted on channel member 62 as shown in FIG. 2. In FIG. 9*a*, it will be noted that shaft or spindle 80 extends through or is inserted into opening 65 of bearing member 64 and extends to latch disc 104 and is operational therewith, as explained earlier.

Because the carousel is hand operated and because the operation of the latching mechanism can be rather abrupt, a shock absorbing system is inserted between shaft 80 and carousel disc or platter 22 to provide for smoother operation of the carousel when a container, for example, is being manually forwarded from the initial station 34 to the second station and so on. The shock absorbing system can provide the added benefit of extending life of the different parts of the machine by minimizing shocks or jolts when the carousel is stopped at the next station. The shock absorbing system (shown in FIG. 9*b*) in accordance with the present invention comprises a top plate member 31 and bottom plate member 33. It will be noted that bottom plate member 33 is fastened to flange 82 of spindle 80 using fasteners 81 inserted through holes 33*a*, 33*b* and 33*c* accessed through 33*d* in top plate 31. Top plate member 31 is spaced from bottom plate 33 by rubber shock mounts 84 which are secured to either plate by a friction fit or by fasteners which may comprise threaded inserts 85 and nuts 85A, as shown in FIG. 9*b*. The shock mounts are inserted, respectively, in holes 83A and 83B in the plates with which they are aligned, as shown in FIG. 9*b*.

Also shown in the exploded view of FIG. 9*b* is bracket 98 having a slot 96. This bracket is fastened to the underside of plate 31 so that slot 96 is aligned with opening 35 to receive shaft 92 and pin 94 of knob 88 (see FIG. 9*c*). However, for purposes of utilizing quick disconnect fastening knob 88, a circular member 29 is provided as noted earlier and secured to carousel plate 22 by a number of fasteners such as 29*a*, 29*b*, etc. Circular member 29 is shown in greater detail in FIG. 9*c*. Thus, in FIG. 9*c* there are shown holes 29*a*, 29*b* and 29*c*. Also shown in FIG. 9*c* are bullet-nosed locating pins 86*a*, 86*b* and 86*c*. When carousel 20 is placed over the shock plate 31, locating pins 86*a*, 86*b* and 86*c* protrude or are inserted into holes 31*a*, 31*b* and 31*c*, and in this way provide for rotational movement from the carousel handwheel through the shock absorbing system to the latching mechanism. It will be noted that circular member 29 has an enlarged opening 37 and a smaller opening 39 with a shoulder 41. Thus, as shown in FIGS. 9 and 9*c*, when the carousel is attached to the shock plate 31 by means of shaft 92 and pin 94 being inserted through opening 39, spring washers 93 may be placed in enlarged opening 37 to provide for a snug fit between the carousel and top shock plate 31.

Now referring particularly to FIG. 5, in one embodiment, upon insertion of a container into the exposed receiving station 34, a light beam 40 from a light source 38 shining onto a photocell 42 is broken which sends a signal to a central control unit 300 (FIG. 24) which, in turn, initiates analysis of the inserted container by activating a sidewall eddy current detector 50, as shown in FIG. 6, which may comprise a commercially available unit. Light beam 40 is particularly useful when it is desired to know when a container, such as a non-metallic container, is placed in the station. That is, light beam 40 will be broken even when a non-metallic container, e.g. plastic or paper is placed in the station.

Figure 6A:
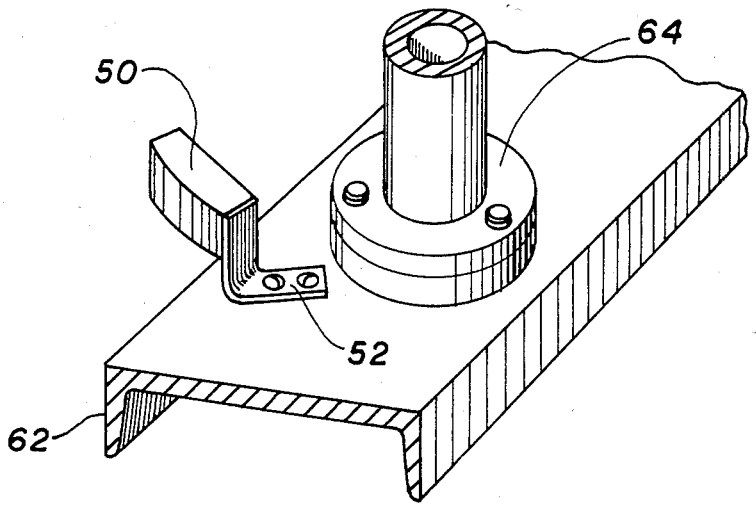
FIG. 6*a* is a fragmentary isometric view of a portion of the apparatus of FIG. 1 showing the mounting of the sidewall detector.
Figure 6B:
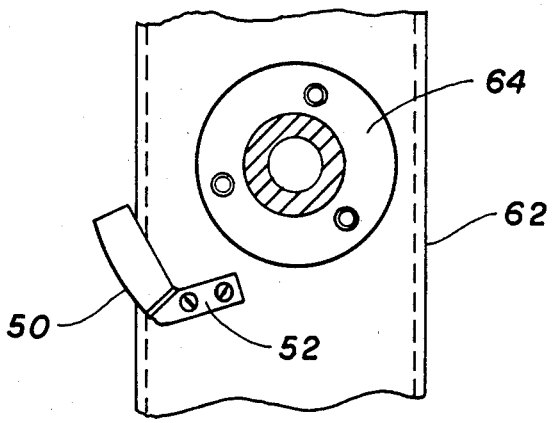
FIG. 6*b* is a fragmentary top view of the sidewall detector mounting shown in FIG. 6*a*.

In a preferred embodiment, illustrated in FIGS. 6, 6*a* and 6*b*, sidewall detector 50 remains on at all times, obviating any need for light source 38 and photocell 42. In this embodiment, the insertion of an aluminum container is immediately sensed by detector 50; and a signal is sent to central control unit 300 to activate the remainder of the apparatus, as will be discussed below.

Detector 50 is mounted inside skirt 74 (FIG. 3) via a bracket 52 to channel 62 (FIGS. 6*a* and 6*b*) to locate detector 50 midway up the side of receiving station 34. Detector 50 determines the presence or absence of a metallic sidewall. If no metal sidewall is detected, such as might be possible with the insertion of a container used for frozen liquids, an appropriate signal is again caused to be displayed on display panel 14*a* or 14*b* indicating the nonacceptability of the container.

Detector 50 preferably is adjusted to not only discriminate between metallic and non-metallic sidewalls, but to distinguish steel from aluminum as well. Alternatively, this may be accomplished with an optional detector 70 (FIG. 8*a*) which may be mounted adjacent detector 50. Optional detector 70 may comprise a magnetic detector solely to discriminate between aluminum and steel containers, if desired. This device, however, may be optionally either eliminated (if this function is carried out by detector 50) or selectively disabled for those instances where compacted steel and aluminum containers are to be subsequently put through segregation means at a central processing station.

In the preferred embodiment, whether or not the aluminum versus steel detection is carried out by detector 50 or an additional detector, central control unit 300 will not activate latching mechanism 100 to permit rotation of carousel 20 nor activate other portions of the apparatus, such as crushing means 200, unless the presence of an aluminum container is detected. It will, of course, be recognized that this aspect of the invention may be modified if it is subsequently deemed desirable to also accept containers constructed of other materials such as steel, e.g. where deposits are required by law for all containers.

Detector 50 has a range of detection sufficient to permit it to continue to signal the presence of an aluminum container in container receiving station 34 after latching mechanism 100 is unlatched and rotation of carousel 20 has commenced. This range of detection, which may be termed an "extended presence detection", continues as carousel 20 is rotated until the carousel reaches a point where removal of the container from receiving station 34 would be impossible. The purpose of the extended presence detection is to prevent the removal of a container from receiving station 34 by one attempting to defeat the detection mechanism by removal of the container once the recycling process has been initiated.

The apparatus is further designed to defeat attempts at tampering by an "early presence detector" wherein central control unit 300 is programmed to reject a signal indicating the presence of a metallic container in a station 34 just rotating into view but prior to the possibility of a container being inserted. This, for example, could occur if one were skilled in counterfeiting or tampering. But, for such an early presence detection, detector 50 would continue to send signals to central control unit 300 indicating that aluminum containers were being inserted into the apparatus, even though no containers were actually being inserted.

Figure 7A:
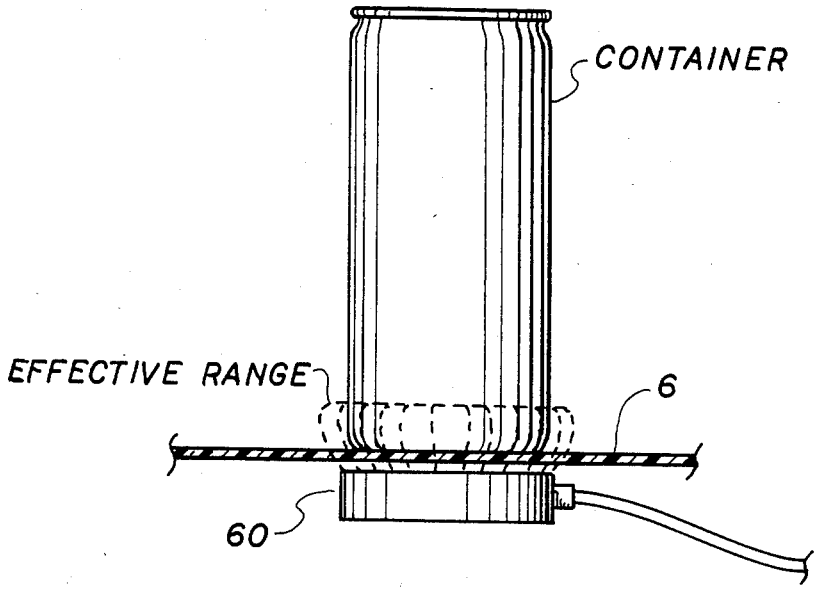
FIG. 7*a* is a cross-sectional view of the bottom wall detector.

As shown in FIGS. 7 and 7*a*, in one embodiment, an eddy current detector 60, which is mounted below top surface 6 of housing 4 and the exposed receiving station 34 portion of carousel 20, scans the underside of the container for inconsistencies indicative of a pour hole or pull tab signifying that the container has been inserted upside down. Eddy current detector 60 may comprise a commercially available unit which electronically scans the lower surface of the container sequentially using a series of detectors, the readings of which are then compared for consistency. Alternatively, a single detector may be mechanically rotated and variations in the readings noted.

If variations in the readings are noted, indicating that the container has not been inserted in an upright position, an appropriate signal is lit on the display panel 14*a* or 14*b* which may be a message telling the user to reinsert the container right side up. It should be noted here that the purpose of this initial determination of the orientation of the inserted container is to avoid contamination of the moving parts of the apparatus with sticky fluids which may cause malfunctioning as well as create a sanitation problem. If for any reason this is deemed not to be a problem, this particular analysis step may be omitted.

Each of the above described detection means operates electrically and without any mechanical movement or sound observable to the user to provide a passive initial screening of the container inserted into receiving station 34. If the container satisfactorily passes all of the tests, an appropriate signal is transmitted to a latching mechanism 100 (FIGS. 10 and 11) which normally prevents rotation of the carousel. Upon receipt of this signal, the latching mechanism is disabled by activation of a release solenoid permitting rotation of carousel 20 with the container inserted in station 34, as will be explained below.

Figure 12:
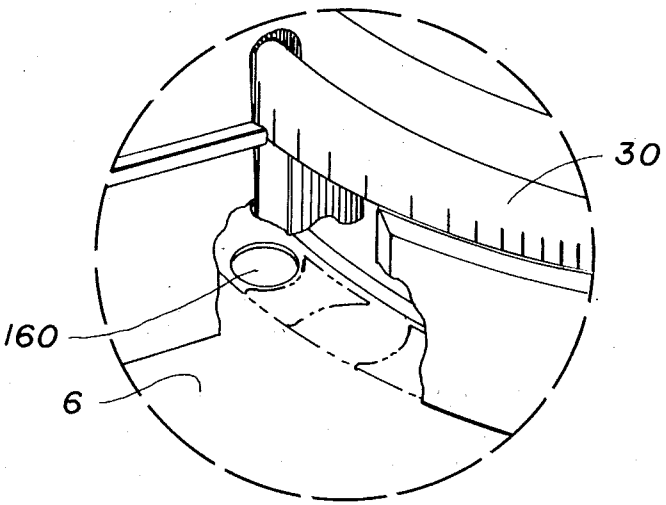
FIG. 12 is a partially cutaway view of a portion of FIG. 1 showing the location of the weight station.
Figure 12B:
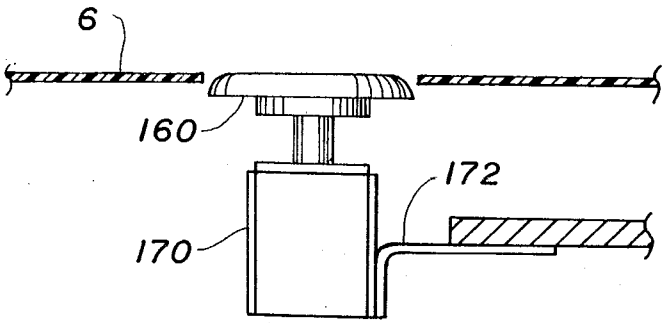
FIGS. 12*a* and 12*b* show fragmentary views of container in two positions at weight station.
Figure 12A:
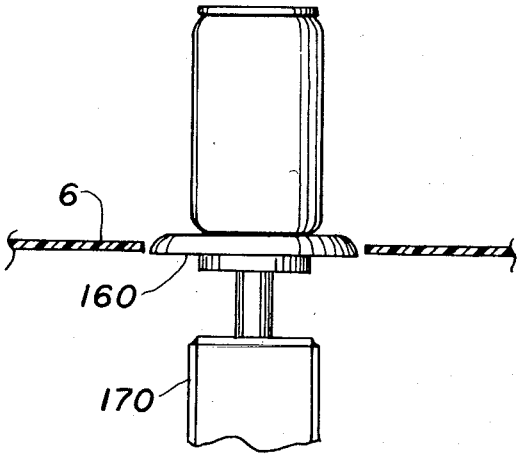

When carousel 20 is first rotated after insertion and initial acceptance of a container, the container passes to a second analysis station where, as shown in FIGS. 12, 12*a* and 12*b*, the weight of the container may be determined.

As carousel 20 moves the container during rotation, the container passes onto a platform 160 which is independent of the work surface, i.e. top surface 6. Coupled to platform 160 is a load cell 170 which measures the weight of the container. Load cell 170 is mounted via bracket 172 to latch plate mounting bracket 90. If the weight exceeds a predetermined amount, indicative of the fact that the container is not empty, the container will not be crushed, but instead may either be passed to a reject station or allowed to fall into a separate receptacle. If desired, central control unit 300 may also have stored therein information with regard to a minimum acceptable weight. This determination may be found to be useful to defeat attempts to circumvent the proper functioning of the apparatus as by insertion of bits or pieces of aluminum rather than a whole container.

Figure 13:
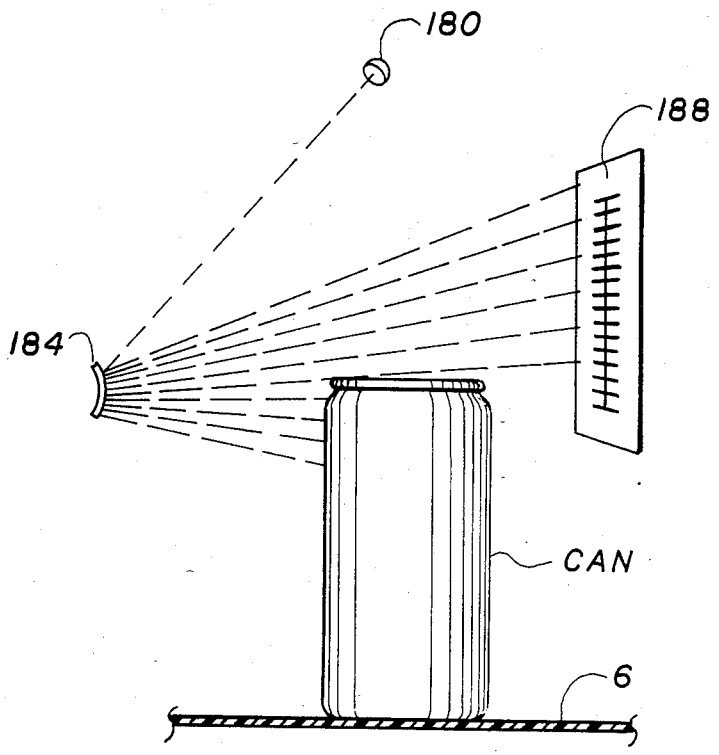
FIG. 13 is a cutaway view of the height measuring station.

As shown in FIG. 13, the height of the container may also be determined in the second station by shining a beam of light from a light source 180 onto a parabolic reflector 184 which reflects the light beam back toward the container and onto a calibrated sensing screen 188 which may comprise a series of vertically mounted photoelectric cells. The portion of the light beam blocked by the container and, therefore, not falling on screen 188, will indicate the height of the container.

The measured height and weight data may be fed into central control unit 300 which may have stored, in appropriate memory cells, information concerning acceptable weight to height ratios indicative of known commercially available containers which may be recycled. If the weight to height ratio does not match, indicative of either a container not empty or a container not otherwise suitable for recycling, the container may then be rejected.

If the container is found to be satisfactory in the second station, it is ready to be transported to a subsequent station for crushing upon further rotation of carousel 20, as will presently be described below. Furthermore, it is at this point of final testing and acceptance of the container for recycling that central control unit 300 stores and accumulates the acceptance in preparation for the issuance of a receipt for the total number of containers accepted.

Figures 14, 14A, 15:
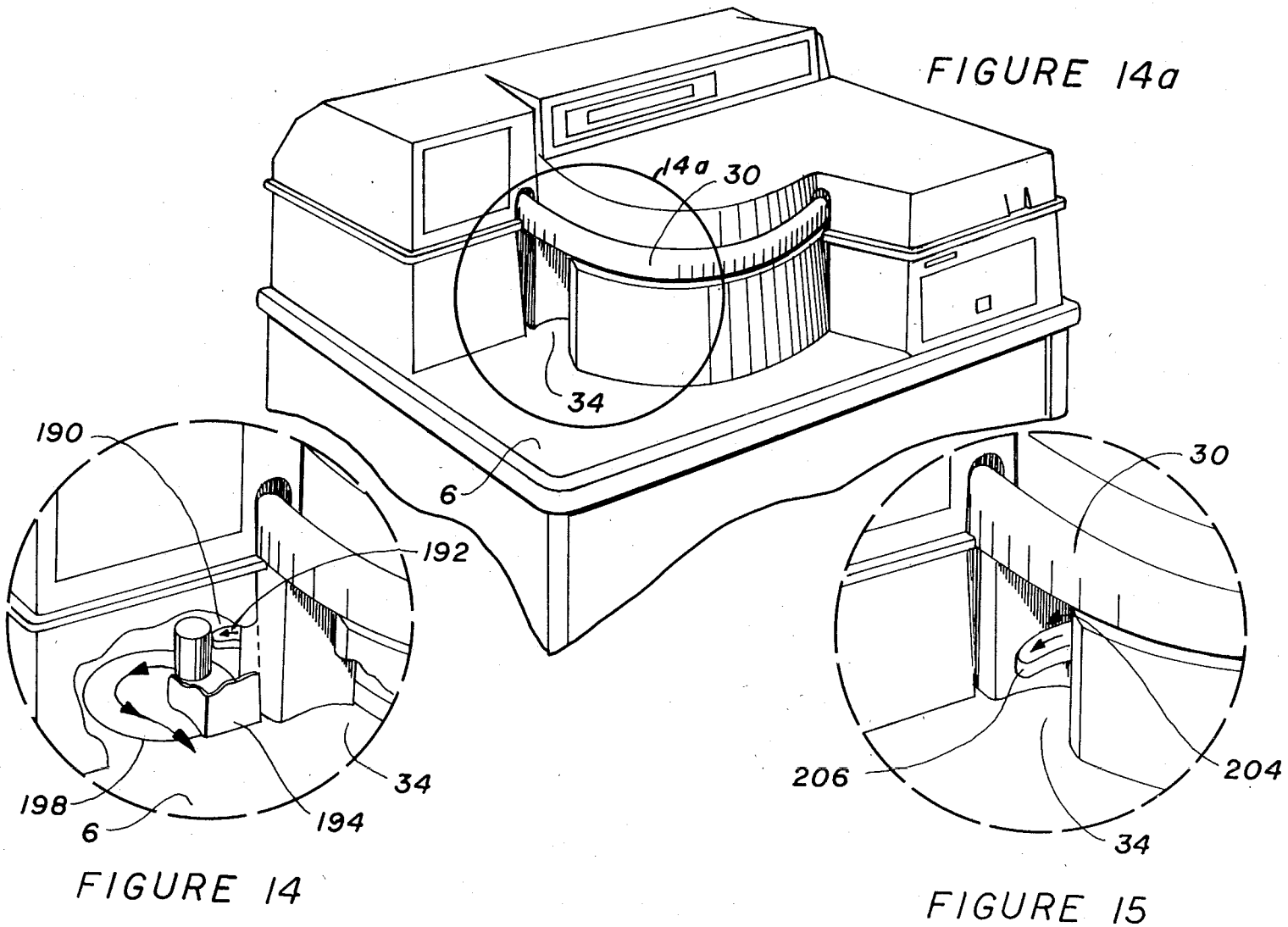
FIG. 14 is a partially cutaway view of a portion of FIG. 1 showing the location of a reject mechanism.
FIG. 14*a* shows exploded view area of FIG. 14.
FIG. 15 is a partially cutaway view of a portion of FIG. 1 showing a refuse mechanism.
Figure 16:
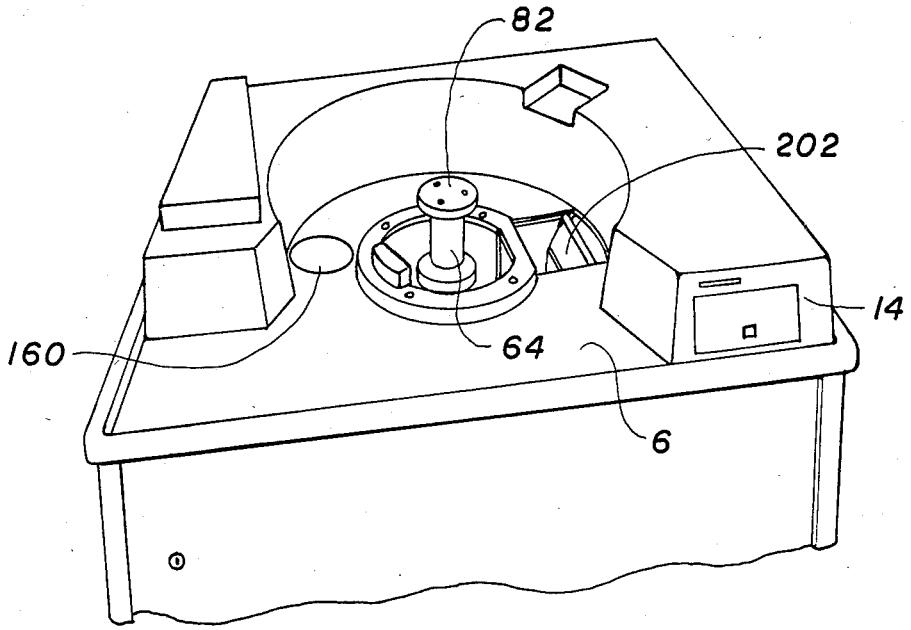
FIG. 16 is a partially cutaway view of FIG. 1 showing the entrance to the crusher mechanism of the apparatus of the invention.
Figure 17:
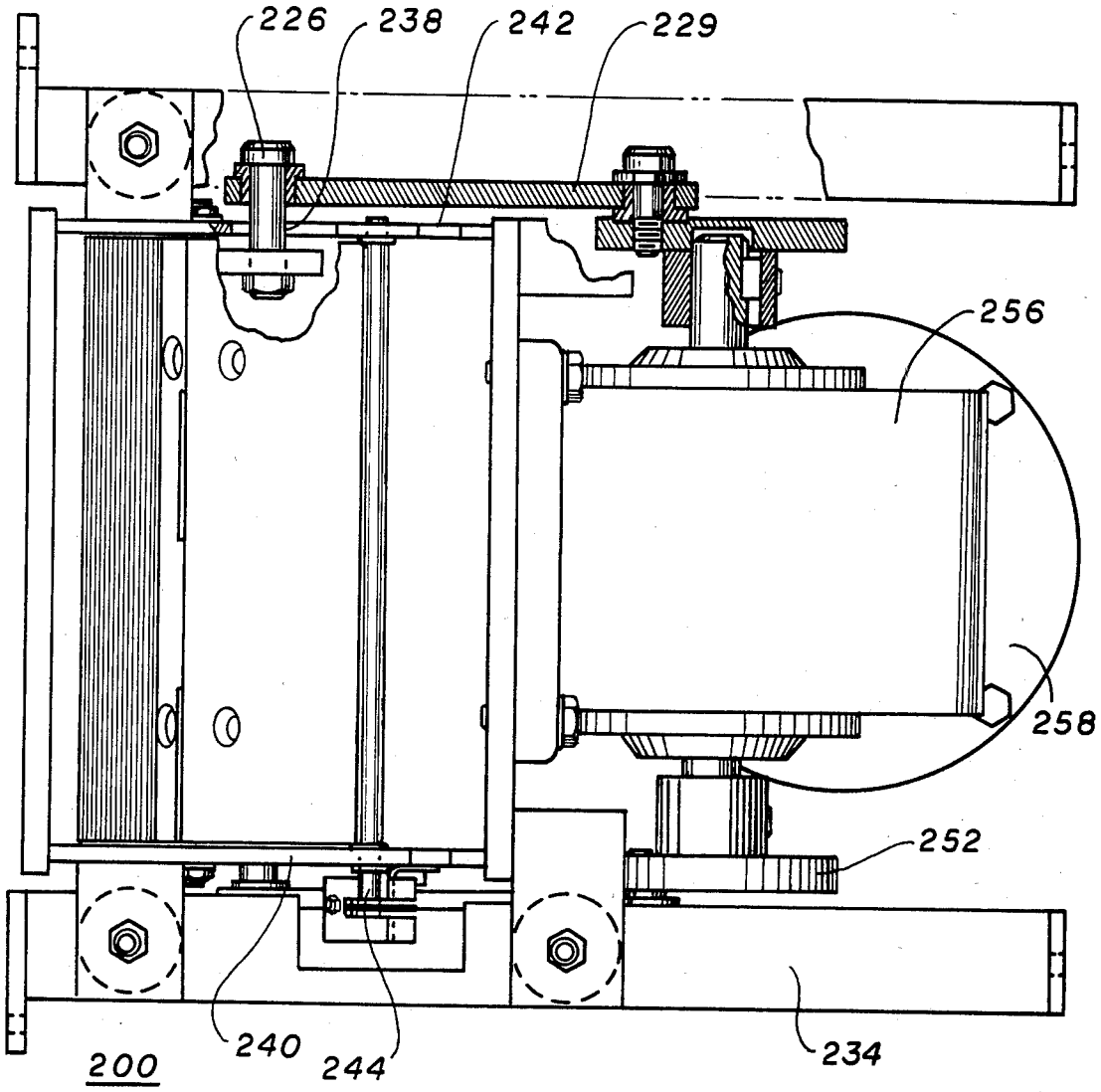
FIG. 17 is a top view of the crusher.
Figure 18:
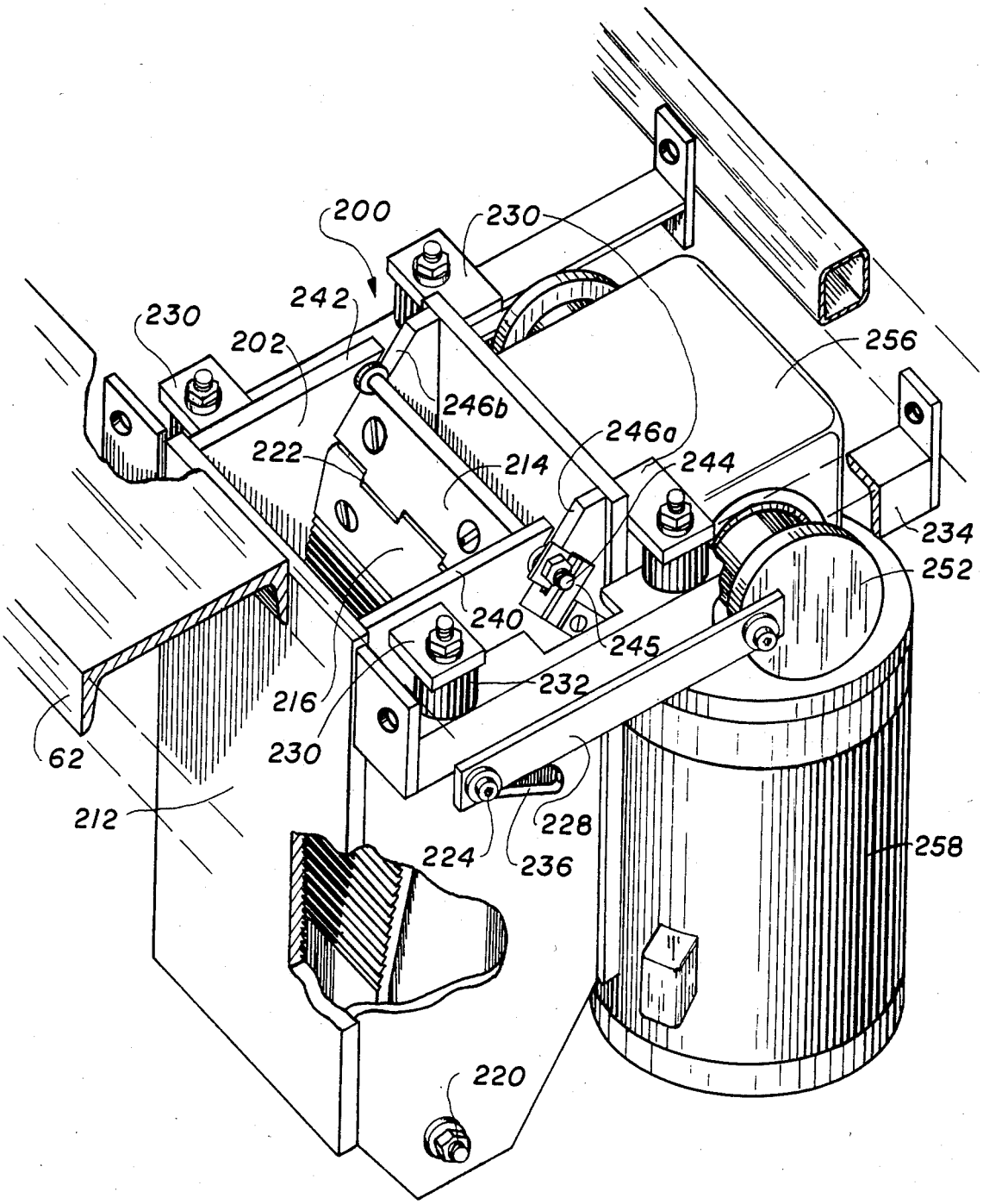
FIG. 18 is a partially cutaway isometric view of the crusher.

If, however, the container is to be rejected due to faulty height and/or weight measurements, it may be ejected from the second analysis station in carousel 20 by a rejection mechanism 190 shown in FIG. 14. Rejection mechanism 190 comprises an ejection arm 192 of a solenoid (not shown) energized by a signal from central control unit 300. Ejection arm 192 pushes the rejected container against a wall or finger portion 194 which is positioned over a rotatable turntable 196 which is simultaneously energized by central control unit 300. Turntable 196 rotates the container to an exit station 198.

In an alternate embodiment, a refuse mechanism may be provided for initial receiving station 34 incorporating some of the features of reject mechanism 190. As shown in FIG. 15, a refuse mechanism 204 comprises a solenoid arm 206 which is powered by a solenoid (not shown). If any of the initial tests (bottom wall detector, sidewall detector, etc.) are unacceptable, central control unit 300 energizes the refuse solenoid to push the container out of station 34.

Crushing means 200, as seen in FIGS. 16–23, is located below an opening 202 in top surface 6 through which the container passes upon further rotation of carousel 20. When a signal is sent to central control unit 300 by detector 50 indicating the presence of a container in receiving station 34 which is acceptable for recycling, central control unit 300 activates crusher means 200. Crusher means 200 comprises a modified V-shaped opening 210 formed by stationary wall 212 and an extension 214 of movable member or jaw 216 together with a pair of sidewalls 240 and 242. Sidewalls 240 and 242 are each provided with a pair of mounting ears 230 which are used to shock mount crusher means 200 to a bracket 234 via rubber bushings 232. Extension 214 is hinged to jaw 216 at 222 and is provided with a guide pin 244, the ends of which ride, respectively, in slots 246*a* and 246*b* in sidewalls 240 and 242. Extension 214 acts as a container guide to direct falling containers into engagement with crusher jaw 216.

Movable member 216 is pivotally attached, at its lower end, to sidewalls 240 and 242 by a pin 220. Spaced from the lower end of member 216, a pair of pins 224 and 226 are mounted respectively each on one side of member 216 and pass through slots 236 and 238, respectively, in sidewalls 240 and 242. Pin 224 is attached to a lever 228 and pin 226 is attached to a lever 229. Levers 228 and 229 are mounted eccentrically to wheels 252 and 254 on opposite sides of a gearbox 256. Gearbox 256 reduces the speed of a motor 258 which is used to power crushing means 200. As the container to be crushed falls through opening 202, motor 258 moves jaw 216 from an open position toward the fixed or stationary wall 212. It should again be noted here that motor 258 was activated by central control unit 300 upon reception of a signal from detector 50. Thus, the falling of a container into opening 210 (FIG. 19) may not always coincide with the opening of jaw 216. However, since the movement of jaw 216 is reciprocal from an open to shut to open position, this is not important.

Figure 19:
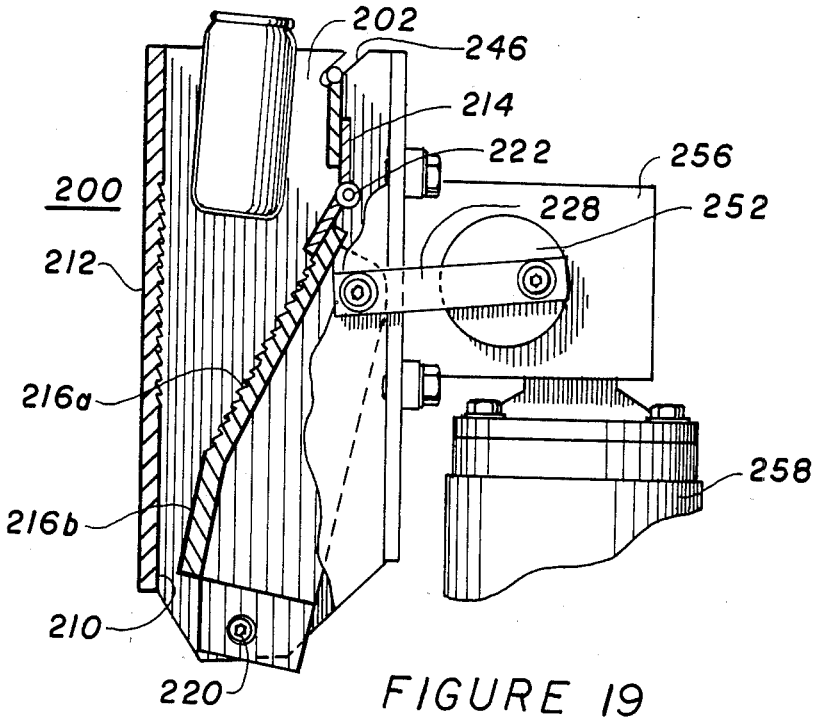
FIG. 19 is a side section view of the crusher with the jaw open.
Figure 20:
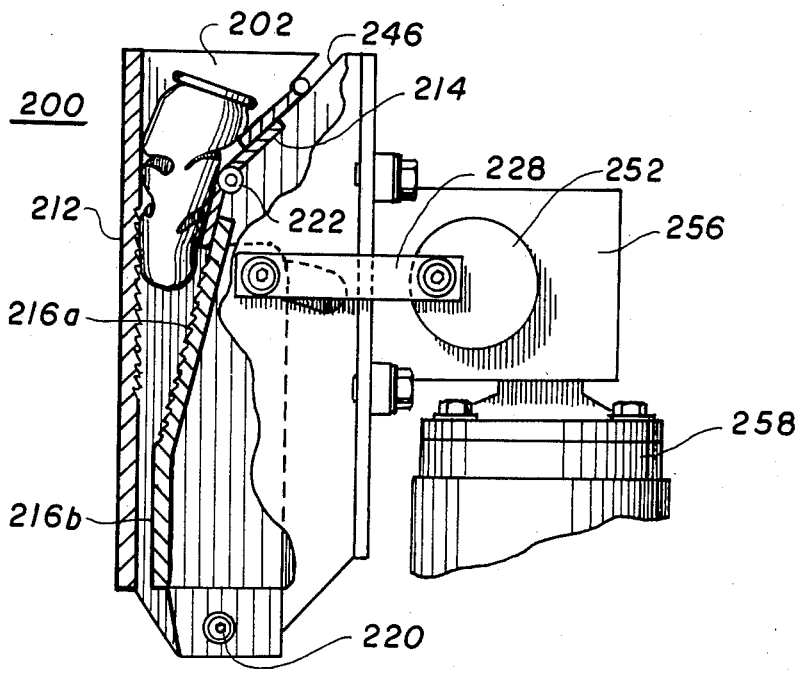
FIG. 20 is a side section view similar to FIG. 19 except that the crusher is closed with a container in the upper portion of the jaw.
Figure 21:
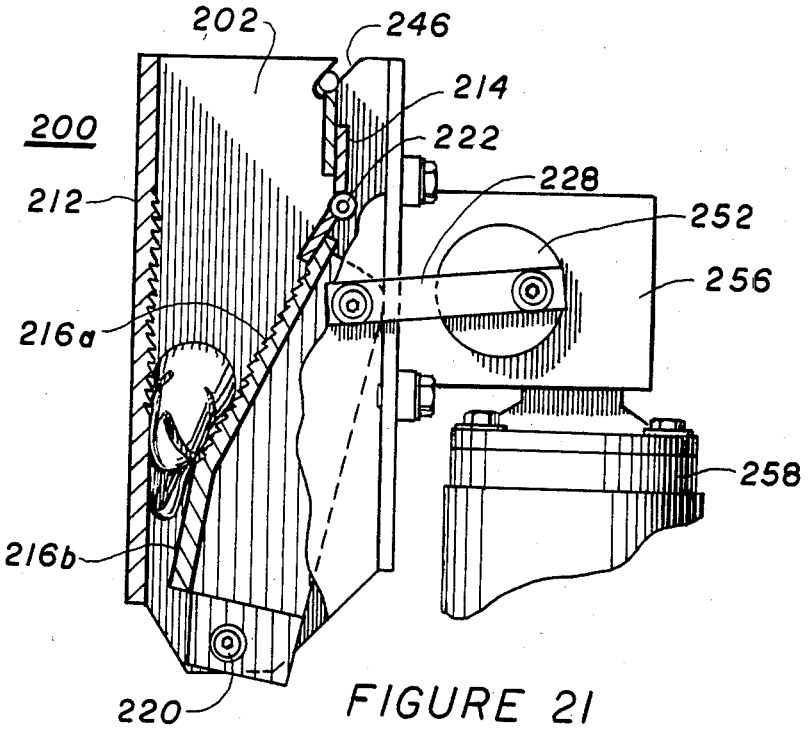
FIG. 21 is a side section view similar to FIG. 20 except that the crusher is back open with a partially crushed container in the lower portion of the jaws.

As seen in FIGS. 19 and 20, a container falling through opening 202 into crusher means 200 will fall into contact with bent portion 216*a* of jaw 216. After movable jaw 216 has moved to its extreme closed position as shown in FIG. 20, it moves back to an open position (FIG. 21). If the container has been sufficiently crushed between wall 212 and jaw portion 216*a*, it will then fall through the opening 210 defined between fixed wall 212 and jaw 216 into receptacle 280 (FIG. 23) in the bottom portion within closure 4. Crusher means 200, and more particularly crusher motor 258, will continue to run for 45 seconds in the preferred embodiment after the last signal sent to central control unit 300 by detector 50 indicating the presence of an acceptable container in receiving station 34. This is deemed to be a sufficient time period to permit further rotation of the carousel after insertion of the last container. After expiration of this time period, central control unit 300 shuts off motor 258.

Figure 22:
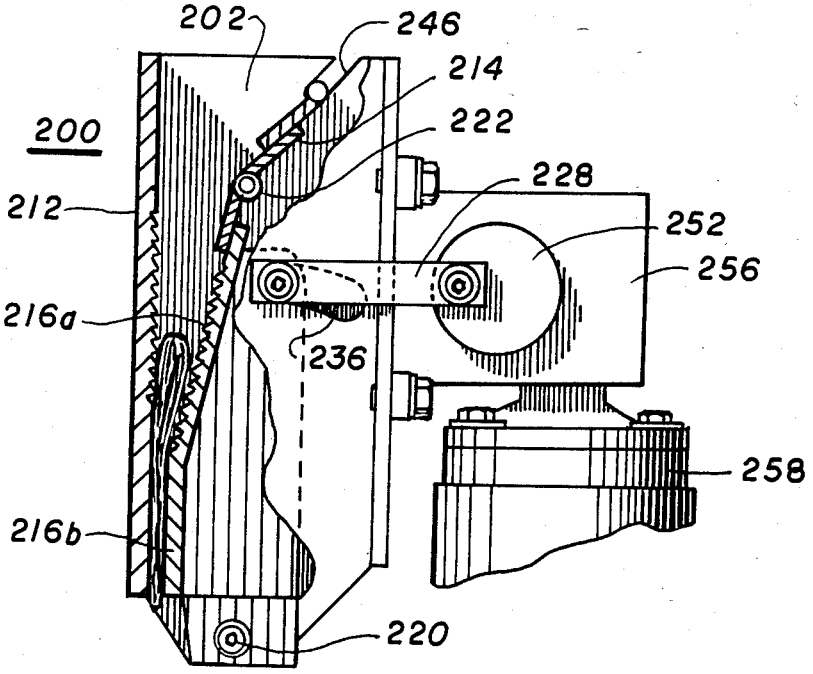
FIG. 22 is a side section view of the crusher in a closed position with a container in the lower portion of the jaws.

However, if the container is not sufficiently crushed to fall completely through opening 210, the reopening of movable jaw 216, as shown in FIG. 21, (upon subsequent reactivation of crusher means 200 by central control unit 300) will permit the container to fall to a point where it will be further crushed between wall 212 and the lower, straight portion 216*b* of jaw 216 during a second closing or crushing motion of jaw 216, as shown in FIG. 22. Therefore, if the container is not crushed sufficiently during the first pass to fall through opening 210 as jaw 216 moves back to its open position, the semi-crushed container will, at least, fall deeper into the opening between wall 212 and jaw 216. The second movement of jaw 216 toward wall 212 will engage the semi-crushed container between straight portion 216*b* of jaw 216 and wall 212 at the full closed position of jaw 216, thus crushing the container sufficiently on the second pass to permit it to fall through opening 210.

It should perhaps be further noted here that the apparatus does not require that an accepted container be crushed prior to issuance of a receipt. After the last container is inserted and accepted (by successfully passing the weight test in the second station) a receipt issued will include that container even if the 45 second period elapses and the crusher shuts down before crushing the last container. The last container will simply remain in the apparatus and be crushed when the next user reactivates the apparatus by insertion of another container.

Disabling means, such as a photocell, may also be provided to be activated if the container does not fall through opening 210 within a predetermined number of crushing cycles to indicate to the user that the crushing mechanism is jammed or, alternatively, that the holding receptacle beneath crushing means 200 is full (FIG. 23) and can accept no further crushed containers. That is, a light beam from source 282 may be directed across bin 280 to a reflector 284 and then to a photocell 285 which can be programmed to stop the machine when the beam is broken which is indicative of a full bin. With respect to jamming of the crusher jaws, a switch may be employed to determine the continuation of the crushing cycle. If the crushing mechanism stops for any reason, such as when an object is jammed in the jaws, or as a result of electrical or mechanical failure, the absence of crusher jaws recycling is detected by switch 245, and the machine is stopped by a signal being relayed to the central control unit by switch 245.

In either event, the disabling means may be used to activate a visual and/or audible signal indicating that service personnel should be summoned to remedy the problem. The disabling means should also be capable of overriding the delatching mechanism so that no further containers may be inserted into apparatus 2 until the problem has been remedied.

In a preferred embodiment, means are also provided in apparatus 2 (FIG. 8) for reading a code which may have been placed on the container, such as the Universal Product Code (UPC), which is placed on food and beverage containers. This coded information may, in certain instances, contain data with regard to amounts and sources of prepaid deposits as may be required by the laws of the several states. This information is read and stored in appropriate storage means to provide proper credits or debits based on deposits prepaid or owed. For example, the UPC reader may keep records of individual manufacturers who have collected deposits on containers and then print out a total on a monthly basis showing how much that manufacturer should be billed. The printout may be a monthly accumulation of the containers collected from various manufacturers with separate totals for each.

As shown in FIG. 8*a*, UPC reader 270 may be placed adjacent station 34 at 274 to read the code as the container is initially inserted into the exposed station 34. Instructions may be provided on display panels 14*a* or 14*b* to indicate the proper orientation of the coding indicia during insertion of the container into station 34 to insure proper functioning of code reader 270.

If desired, the machine may be set up to add the proper reading of the UPC to the other initial screening functions which must be successfully completed prior to activation of latching mechanism 100 to permit rotation of carousel 20 to allow insertion of further containers. Alternatively, the device may be arranged to simply ignore the absence of an acceptable code if this is not deemed necessary to the functioning of the apparatus.

For purposes of limiting the inventory of cans, for example, which a bottler has to keep in stock, depending whether he is shipping to a deposit or non-deposit state, an additional code can be affixed to the top or bottom of the can. This additional code may be complementary to the UPC. Thus, a complementary code scanner 275 may be located in the bottom of station 34, as shown in FIG. 8. Or, a scanner may be placed over the entrance to station 34 to read the complementary code on the lid, as indicated in FIG. 8*b*. The information read from the complementary code is read and stored in the appropriate storage means to provide proper credits and debits based on deposits, as noted hereinabove.

Figure 24:
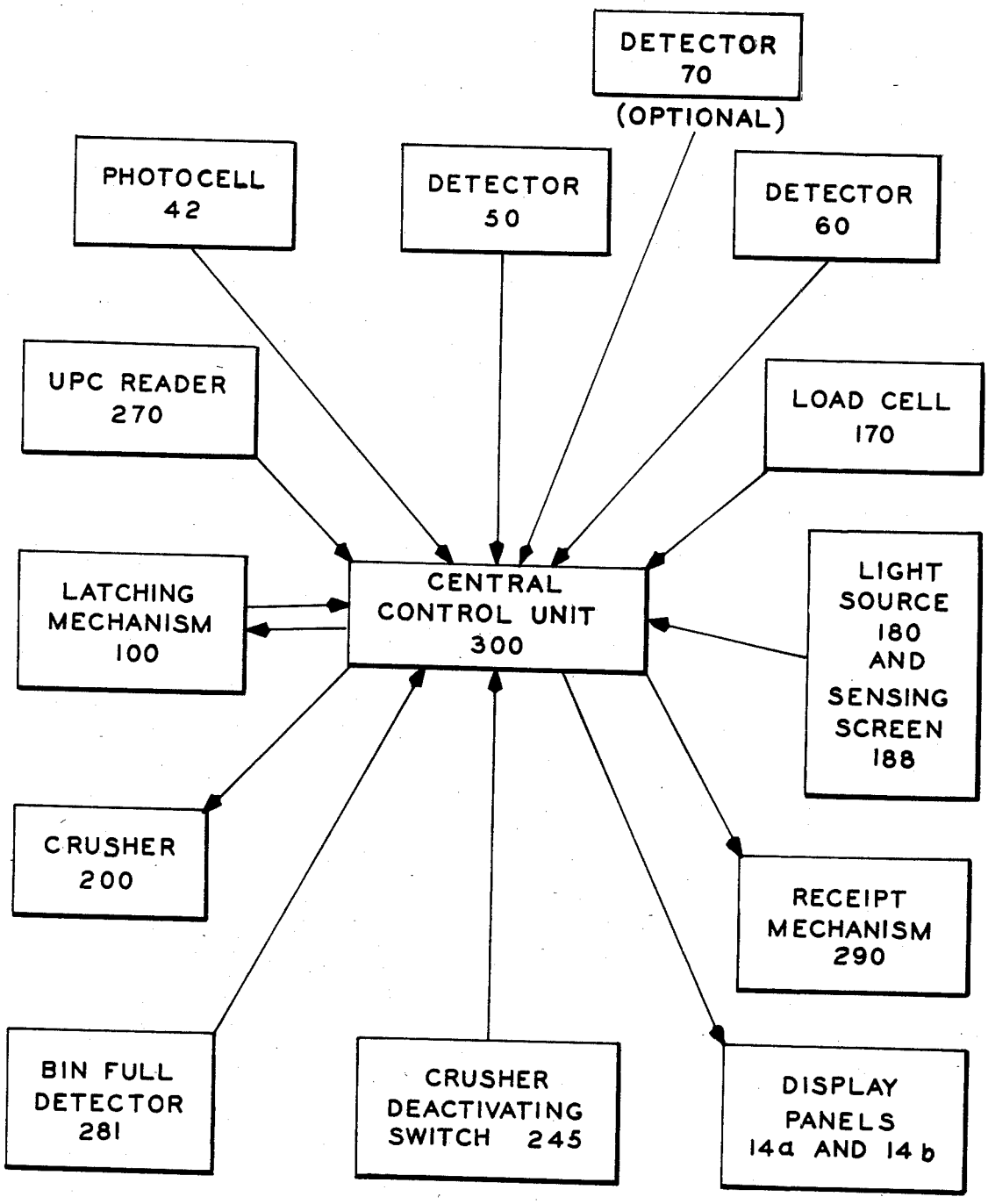
FIG. 24 is a block diagram interaction of the components of the apparatus of the invention.

Referring now to the schematic diagram shown in FIG. 24, in the operation of the apparatus of the invention, a container is inserted into the exposed station 34 of carousel 20 breaking the path of beam 40 from light source 38 shining onto photocell 42. A signal is then sent from photocell 42 to central control unit 300 which, in turn, activates sidewall detector 50, bottom wall detector 60 and, optionally, steel-aluminum detector 70 and Universal Product Code (UPC) reader 270. The container is then analyzed and the signals from these sources are fed back to central control unit 300. If the signals received indicate the presence of an acceptable container, a signal is sent by central control unit 300 to latching mechanism 100 permitting rotation of carousel 20 via handwheel 30.

The container is thus carried to the second position or station where it may be further analyzed for correct weight and height by signals sent to load cell 170 and light source 180. Signals from load cell 170 and sensing screen 188 are then sent back to central control unit 300. If the height and weight relationship is acceptable, central control unit 300 records the acceptance and accumulates the tally prior to issuance of a receipt. In another embodiment, gross weight alone may be utilized to determine acceptable containers.

If further containers continue to be inserted, the carousel may be again rotated by the user and the timer for crusher motor 258 is reinitiated by central control unit 300. The container passing from the second station then is crushed by crusher jaw 216. At the end of 45 seconds after the last insertion of a container, central control unit 300 sends an appropriate signal to receipt mechanism 290 which then may print a receipt which is redeemable by a cashier in the store in which the apparatus is located. Alternatively, a coin or coins may be dispensed.

If the container is not inserted in an upright position at the first position of station 34, a signal is sent to central control unit 300 which, in turn, causes a message to be displayed to the user on panel **14*a* or 14*b* indicating the problem. Similarly, if the container does not have a proper metallic sidewall or, if the UPC reader is used, it is indicated that the container is unacceptable, central control unit 300 sends signals to the display panels indicating to the user the nature of the problem. In any event, the latching mechanism 100 will not be activated to release carousel 20 until a container acceptable to the apparatus is inserted into station 34. Thus, the apparatus performs a plurality of initial screening tests upon insertion of a container into exposed station 34** and either unlatches the carousel or displays the appropriate message indicating the reason for unacceptability without any movement perceptible to the user.

Similarly, the finding of an unacceptable height or weight or a relationship determined by a ratio of height to weight in the second screening position or station may result in shutdown of the machine, ejection of the container or rerouting of the container into a separate storage area.

Figure 25:
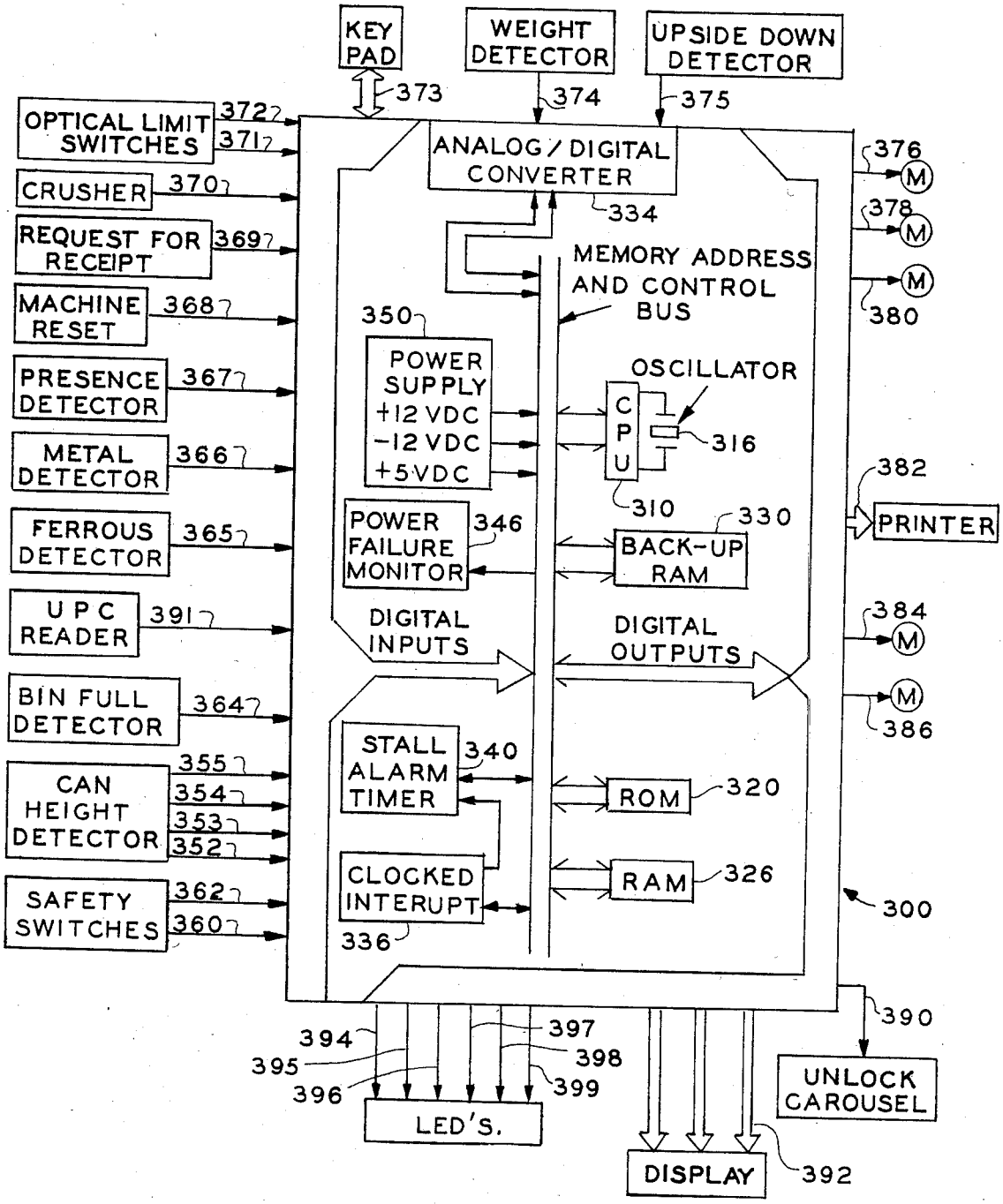
FIG. 25 is a diagram of a microcomputer used to monitor and control the process of the invention.

As discussed earlier with respect to FIG. **1*b*, central control unit 300 is mounted on control panel 404 on the front of recycling unit 2. Central control unit 300 may be an electromechanical timing unit. Preferably, however, central control unit 300 is in the form of a microcomputer having a functional block diagram, as shown in FIG. 25. Referring to FIG. 25, central control unit 300 comprises a microprocessor 310; an oscillator 316; a read-only memory (ROM) 320; a primary, volatile, random access read/write memory (RAM) 326; a secondary non-volatile, random access read/write memory (RAM) 330; a clocked interrupt 336; a stall alarm timer 340; a power failure monitor 346; a power supply 350; inputs 352–375; and outputs 376–399**.

Microprocessor 310 preferably comprises an 8 bit microprocessor having integral clock circuits, such as, for example, an MC6808 microprocessor available from Motorola. Oscillator 316 has a 4 MHz crystal to produce a 1 MHz instruction cycle rate to control the clock circuits in microprocessor 310. The double-arrow lines denote data buses and address buses.

The operating program and data concerning, for example, the weight range of an acceptable container, are stored in the read-only memory 320 which contains 32K of memory space. The data derived during operation is stored in the primary random access memory 326 which has 2K of random access memory. The secondary, or back-up, random access memory 330 has an independent power supply which may consist, for example, of a lithium battery having a five year life. Secondary RAM 330 contains 256 bytes of CMOS (low power consumption) memory. Secondary RAM 330 is used for storing of data during power interrupts, as will be explained below.

Figure 26:
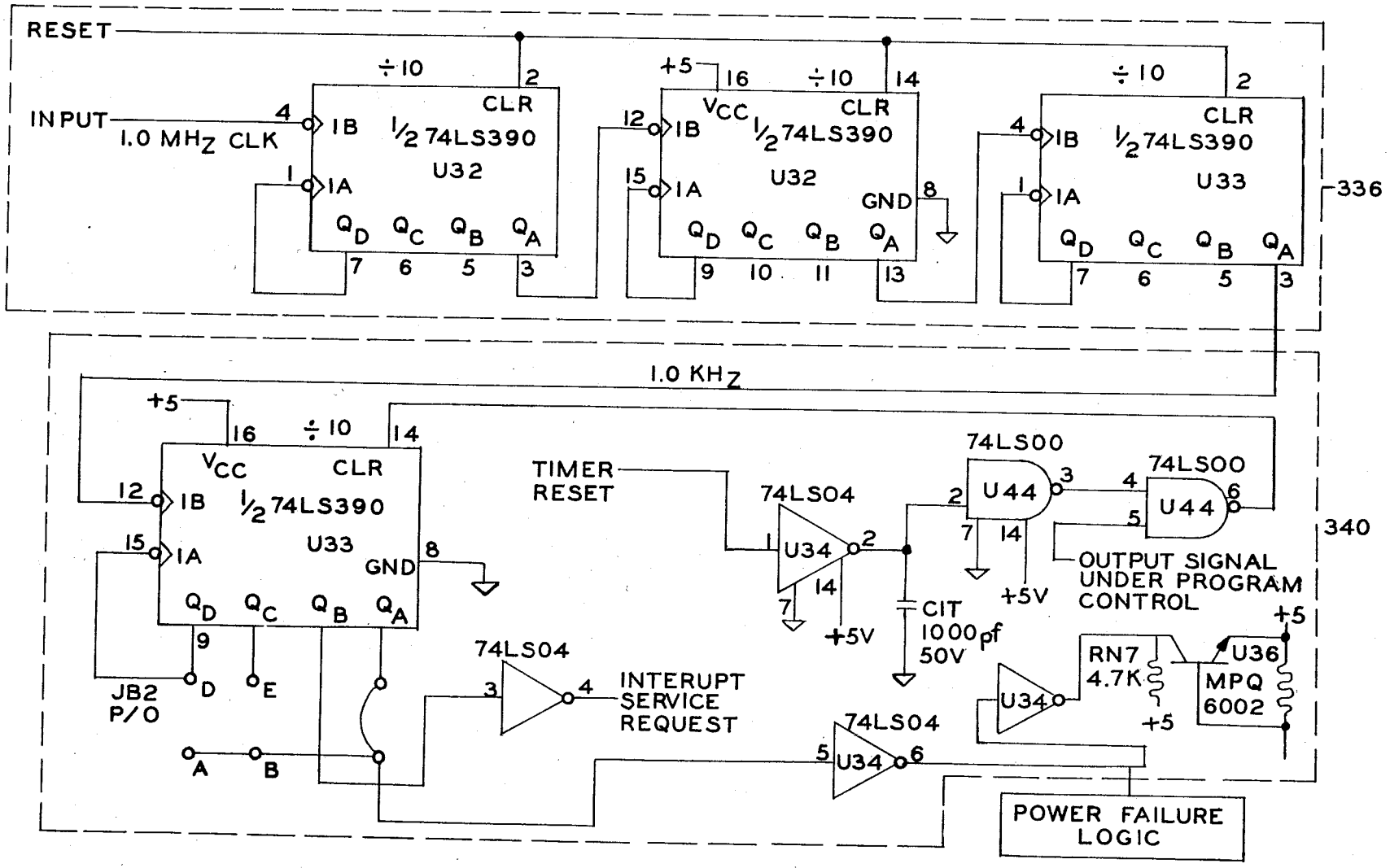
FIG. 26 is a circuit diagram of a clocked interrupt and a stall alarm timer circuit used in the microcomputer of FIG. 25.

Clocked interrupt 336 comprises a hardware divider chain, as shown in FIG. 26, which provides central control unit 300 with a timed interrupt which can be used to make accurate measurements of process activity. The commercially available, integrated or serialized circuits (e.g. 74LS390) and their locations (denoted with a U and a number) are shown on the drawing. Clocked interrupt 336 and stall alarm timer 340 provide a circuit which measures the response time of central control unit 300 and deenergizes all AC loads, such as the crusher motor, if central control unit 300 fails to respond to the timer circuit in a specified period of time.

Figure 27:
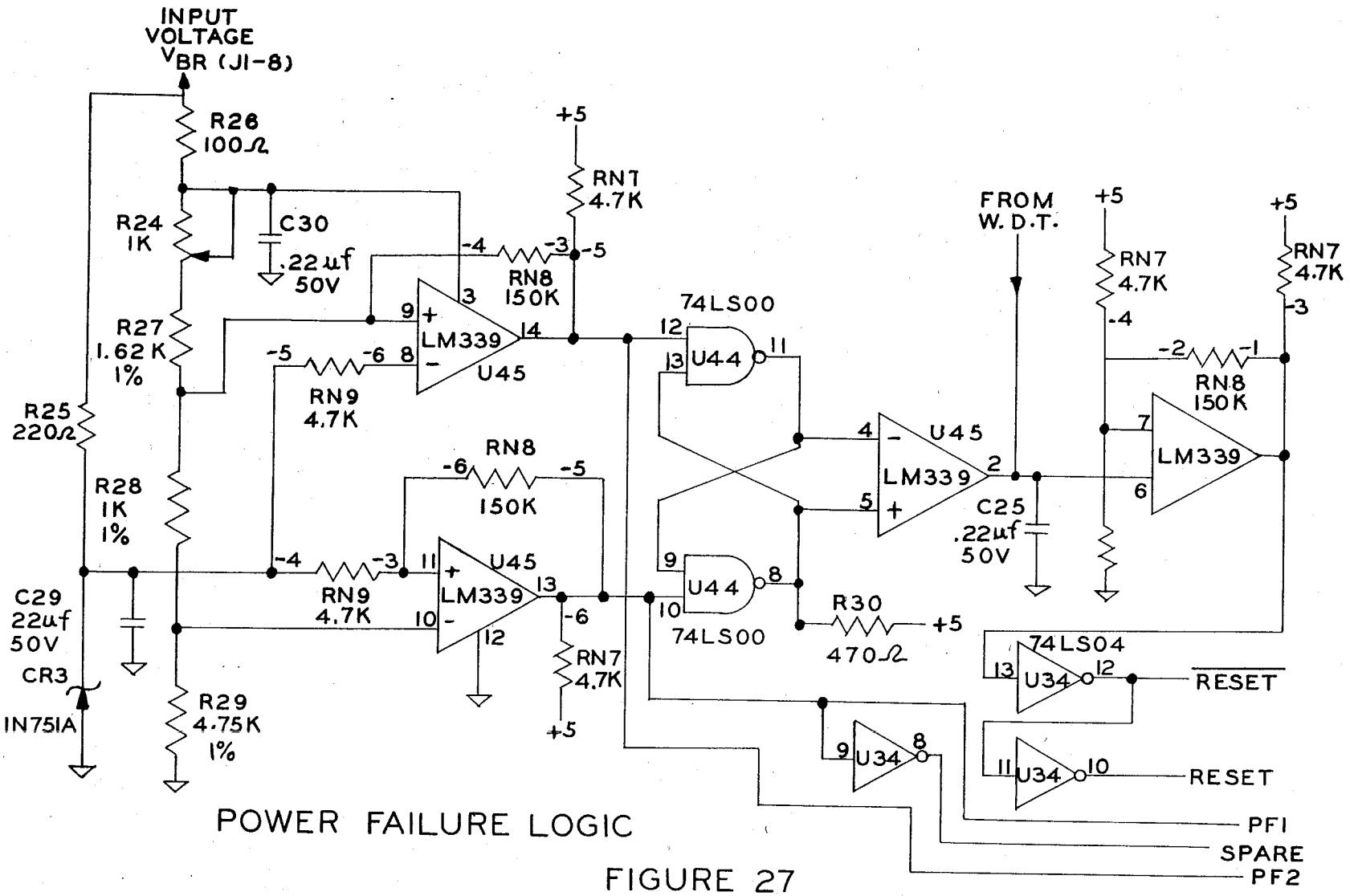
FIG. 27 is a circuit diagram of a power failure monitoring circuit used with the microcomputer of FIG. 25.

Power failure logic or circuit 346, as shown in FIG. 27, monitors the AC line voltage and provides a signal to microprocessor 310 if there is an interruption in power so that microprocessor 310 can take certain actions such as to store data in battery powered RAM 330.

Inputs 352–375 comprise 21 optically isolated digital inputs and 4 direct digital inputs. Outputs 376–399 comprise 15 optically isolated digital outputs and 4 direct digital outputs. The optically isolated inputs and outputs are used to provide noise immunity to central control unit 300 by electrically isolating unit 300 from the input and output devices which respectively monitor and control the individual operational components of the apparatus. In a preferred embodiment, each of the optically isolated inputs is further provided with a light emitting diode (LED) status indicator on control panel 404 within apparatus 2 and accessible via front access panel 8 and security door 54, as shown in FIG. **1*b***.

Figure 28:
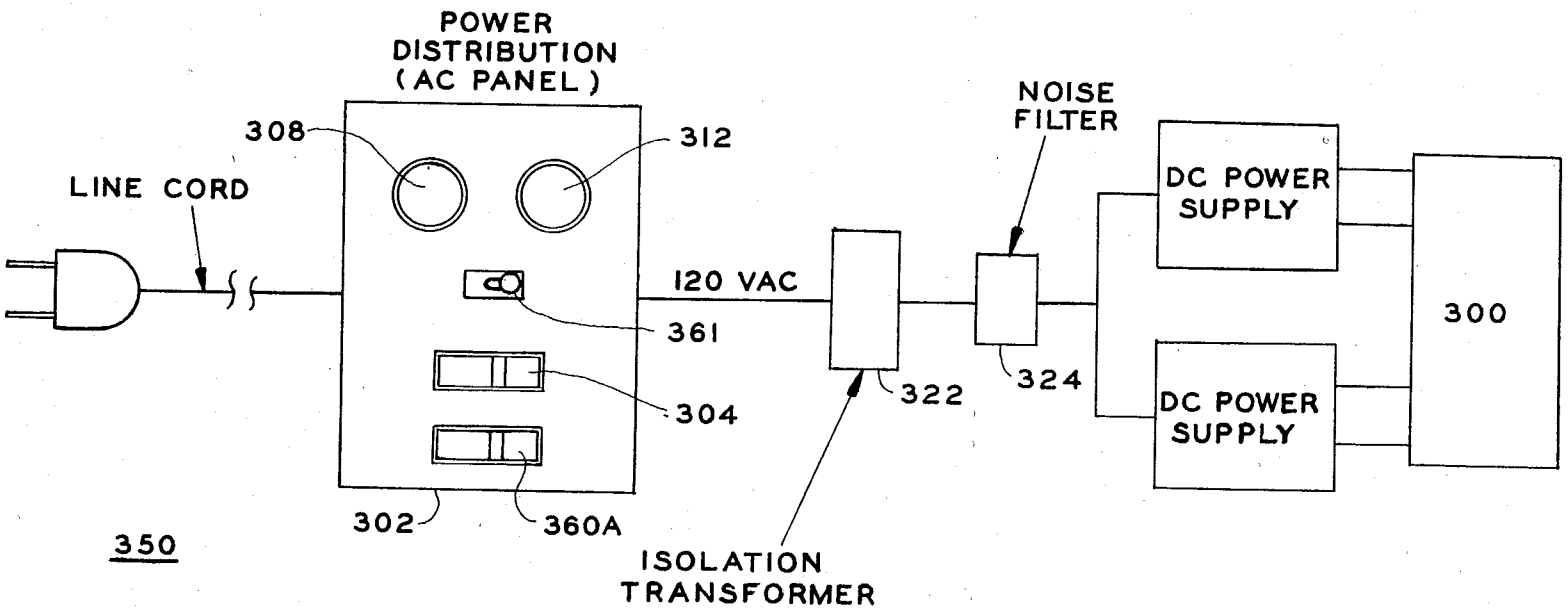
FIG. 28 is a circuit diagram of the low noise power supply used in the microcomputer of FIG. 25.

Power supply 350, which supplies the DC voltages to central control unit 300, is provided with an isolation transformer 322 and an AC line noise suppressor 324, as shown in FIG. 28, to provide further noise immunity to central control unit 300.

Optionally, central control unit 300 may also be provided with an analog to digital converter 334 for input signals not in digitized form, as will be discussed below with respect to the eddy current detector and the load cell for weight determination.

Figure 29:
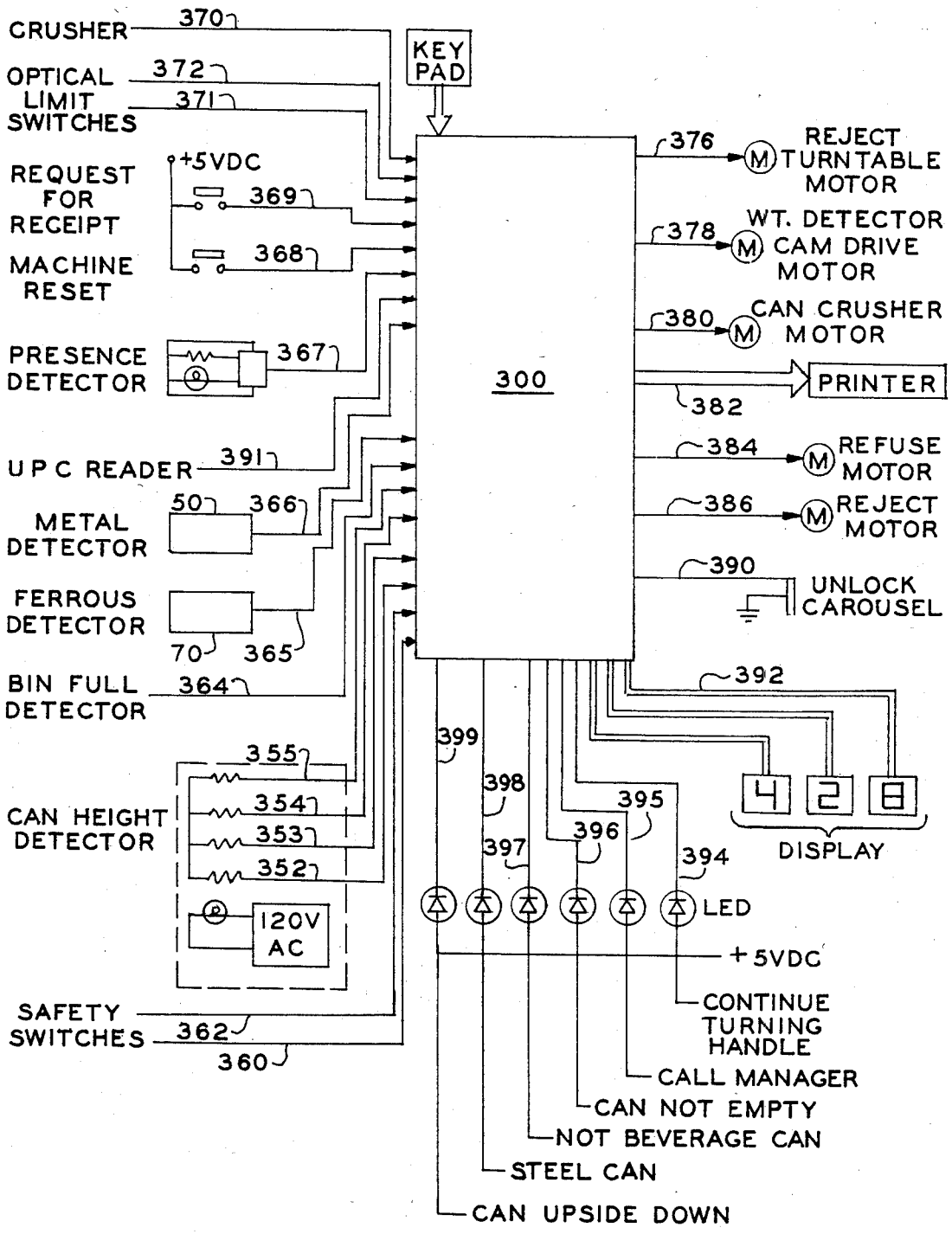
FIG. 29 is a circuit diagram showing the inputs and outputs connected to the microcomputer of FIG. 25.
Figure 30:
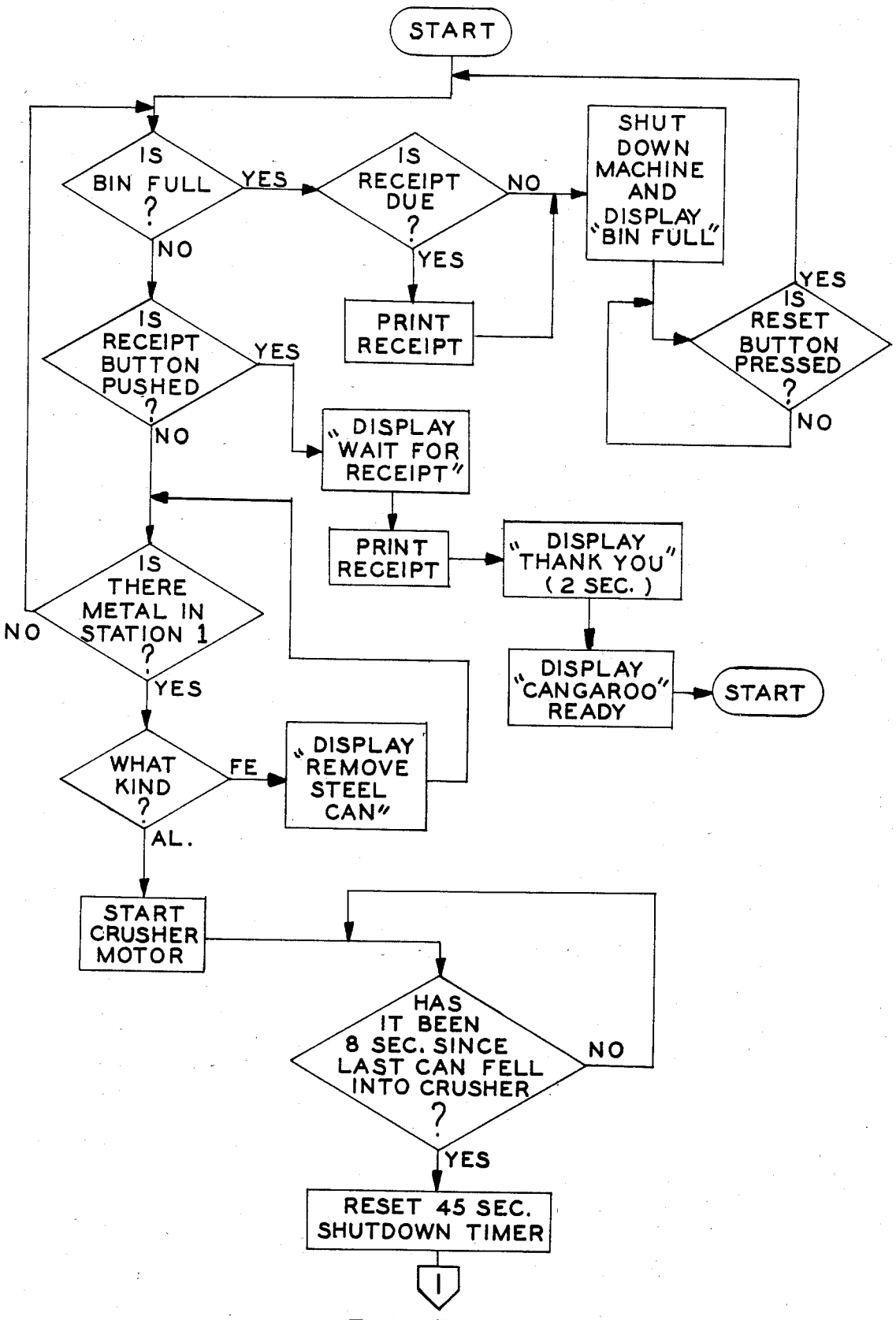
FIG. 30 is a portion of a flow chart showing the programming for the microcomputer.
Figure 31:
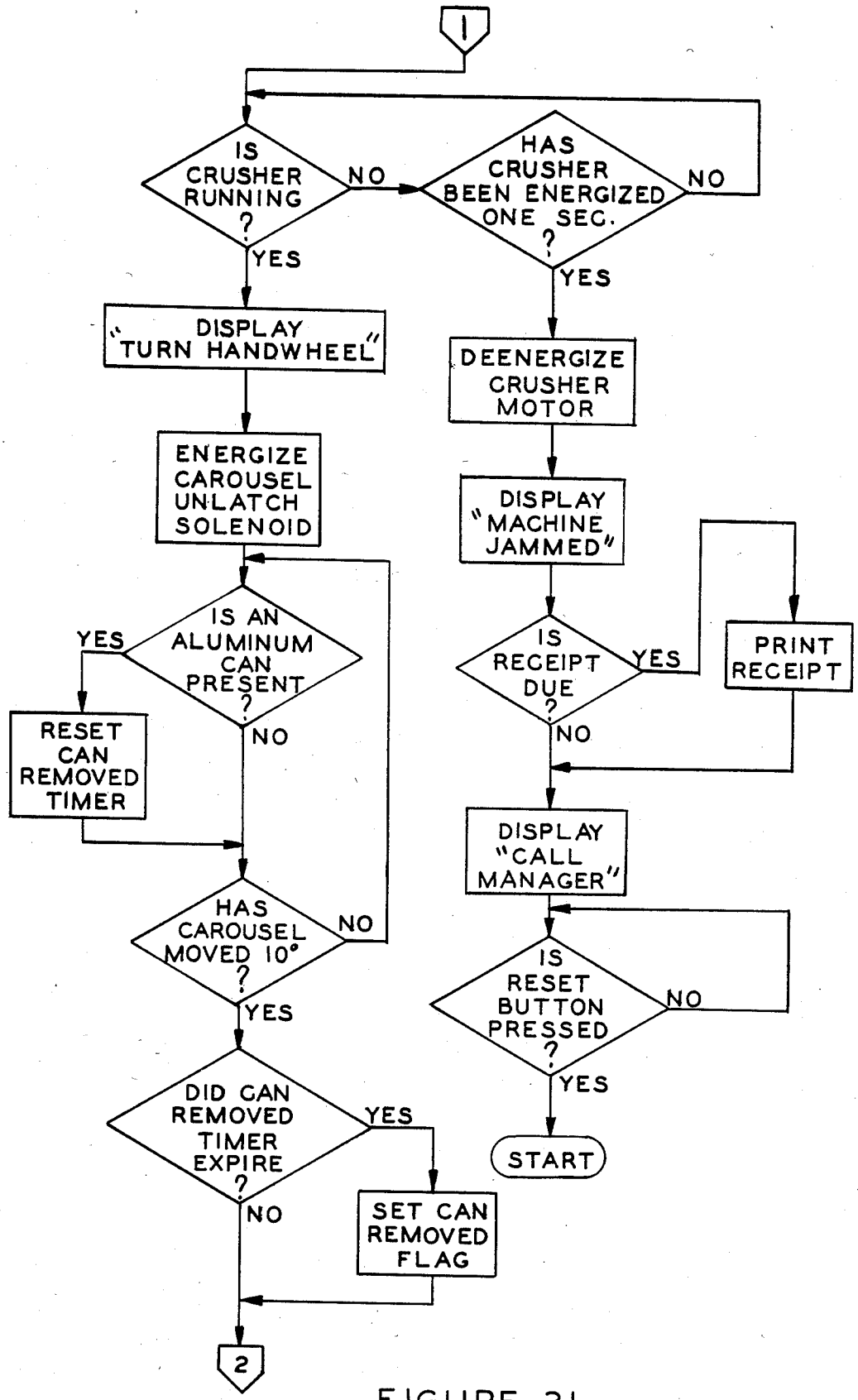
FIG. 31 is another portion of the flow chart which commences with FIG. 30.
Figure 32:
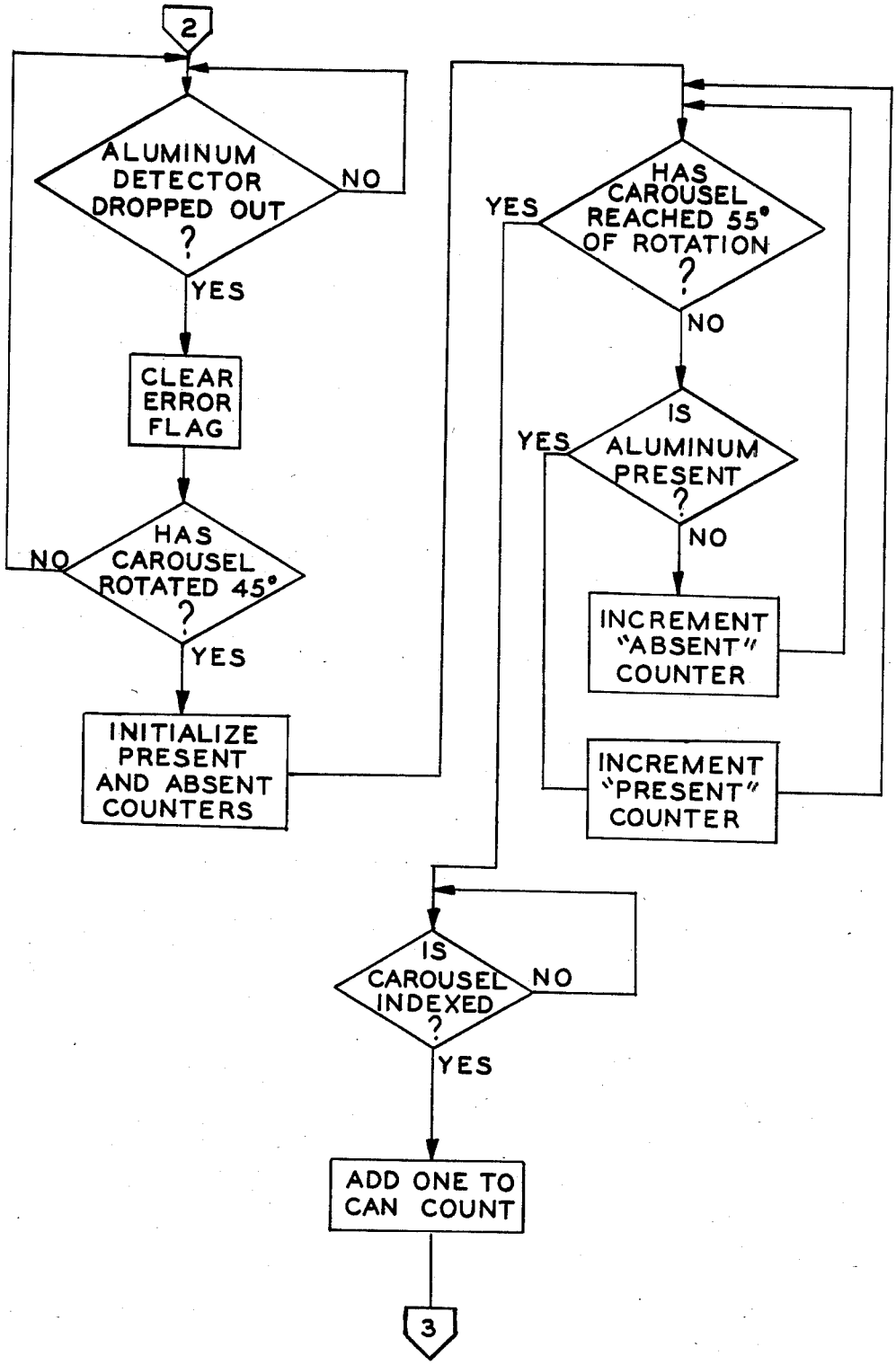
FIG. 32 is a further continuation of the flow chart which commences with FIG. 30.
Figure 33:
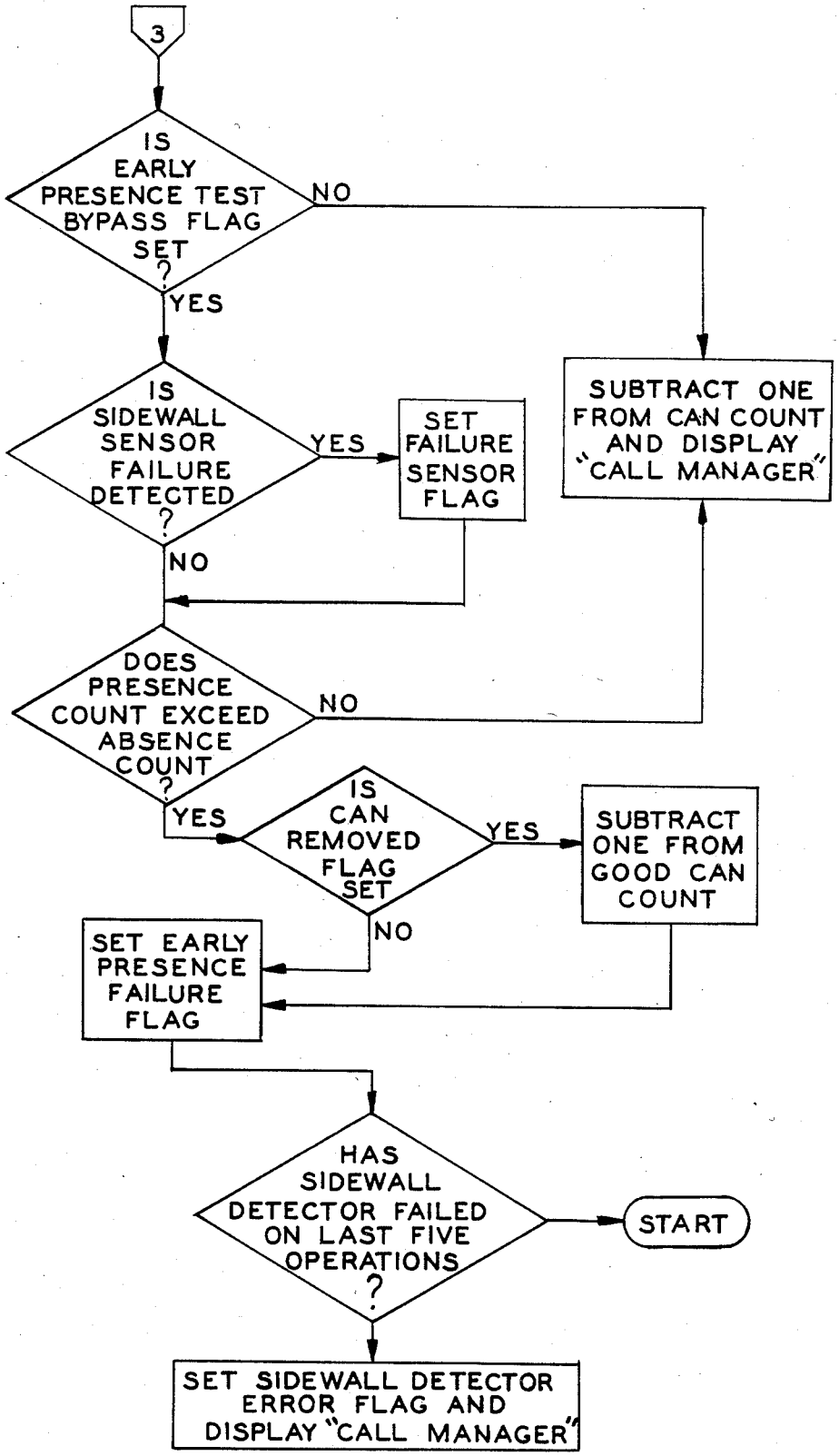
FIG. 33 is a still further continuation of the flow chart which commences with FIG. 30.

Referring now to FIG. 29, inputs 352, 353, 354 and 355 comprise four digitized inputs from a series of vertically mounted photoelectric cells comprising sensing screen 188 of the container height detector, as previously described with respect to FIG. 13. The detected height of the container is compared to a particular weight range for containers of that height. When the container is weighed, the weight is compared to the weight range for this height. If the container weight is not within the range, the can is rejected. Microprocessor 310 then sends a signal via output 376 activating a reject means such as shown in FIG. 13.

Inputs 360 and 362 are connected to safety interlock safety switches 360*a* and 360*b*, as shown in FIG. 1*a*, which deactivate the motors, e.g., crusher motor 258 when, respectively, front door 8 or top cover 16 are opened.

Input 391 is connected to UPC reader 270 or 275 to feed a signal into microprocessor 310 indicative of any code on the inserted container.

Figure 23:
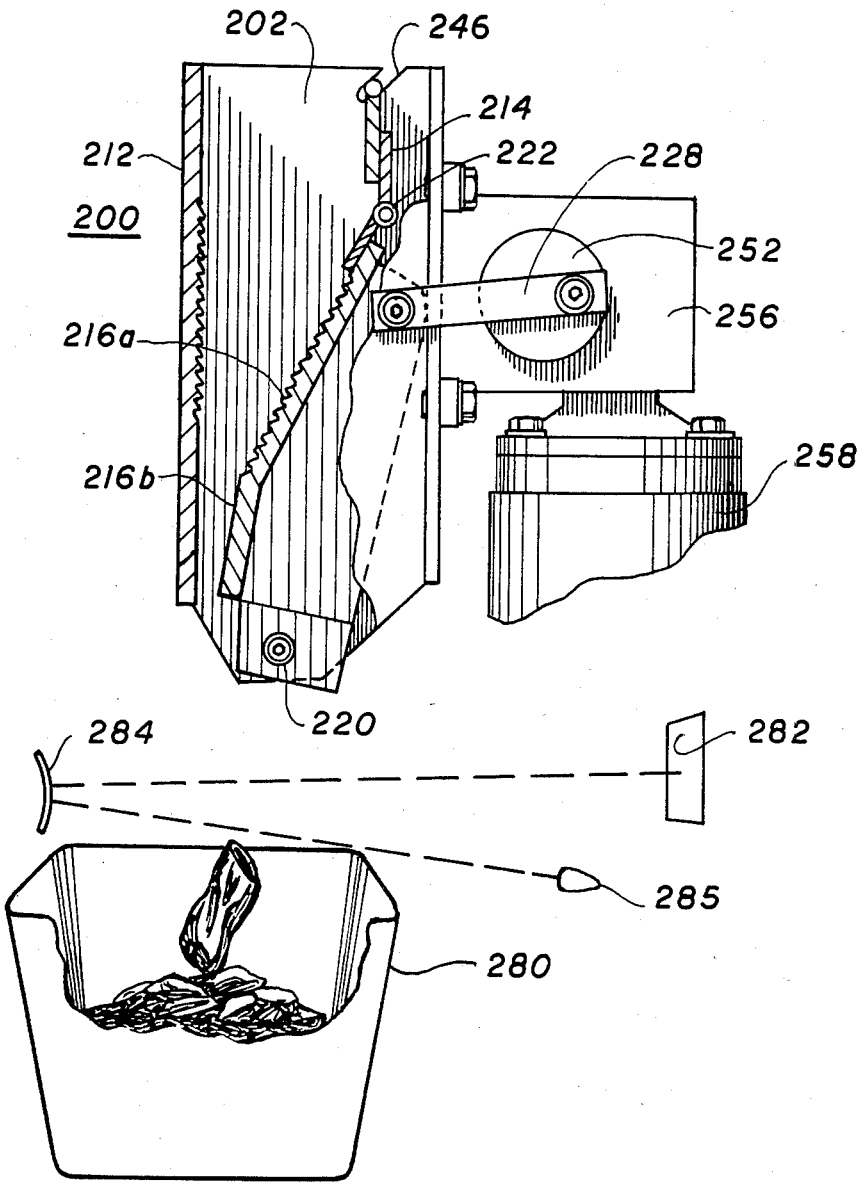
FIG. 23 is a side section view of the crusher with the jaws back open and a crushed container falling into a receptacle below the crusher.

Input 364 is connected to bin full detector 281 which comprises photocell 285 and light source 282, as shown in FIG. 23. When the signal at input 364 changes indicating that the light from light source 282 is no longer reaching photocell 285 because holding receptacle or bin 280 is full, the Call Manager LED is lit; all motors are shut off; and a receipt is printed by receipt mechanism 290.

Input 365 receives a signal from (optional) ferrous metal detector 70 which indicates the presence of ferrous metal (i.e., a steel container). When a signal is received by microprocessor 310 from input 365, the Steel Can LED light is activated as well as refuse motor or solenoid 205.

Input 366 is connected to detector 50 which signals central control unit 300 when a container having an aluminum sidewall is inserted into container receiving station 34.

When a container is inserted into container receiving station 34, a light beam 40 from a light source 38 may be provided which, when interrupted, causes a difference in the signal and photocell 42 indicating the presence of a container (or foreign object). Such a signal may then be transmitted to central control unit 300 via a presence detector input 367.

Whenever the apparatus is shut down for any reason, restarting is accomplished by restart switch 410 which is located on the top of cover 16, as shown in FIG. 1*b*. This, in turn, activates input 368.

A Request for Receipt switch 412, located on the front of cover 16 on the top of the machine, as seen in FIGS. 1*a* and 1*b*, also comprises a momentary push button switch which activates input 369 to signal to central control unit 300 that the customer wishes to have a receipt printed.

Input 370 is connected to crusher motor 258 to provide a signal to central control unit 300 indicating that the crusher is running.

Optical limit switches 105 and 105A monitor the rotation of latch disc 104 and a signal the progress of rotation to central control unit 300 via inputs 371 and 372.

A key pad 416, as seen in FIG. 1*a*, comprises a sixteen character keyboard which may be used as an auxiliary input for maintenance purposes. Key pad 416 is interconnected with central control unit 300 via input 373.

Weight detector 170 is connected via input 374 to central control unit 300 to transmit data concerning the weight of the container inserted into the apparatus. The output from weight detector 170 may be in digitized form or, alternatively, input 374 may be via analog-digital converter 334 to central control unit 300, as shown in FIG. 25.

Similarly, input 375 from upside down detector or bottom surface eddy current detector 60 may either be in digitized form or interconnected with central control unit 300 through analog-digital converter 334.

Referring now to the output, central control unit 300 may be programmed to activate the reject turntable motor 406 via output 376. The weight detector cam drive motor 174 may be set to be activated by output 378, and can crusher motor 258 is activated by a signal from output 380. The refuse motor or solenoid mechanism 204 may be programmed to be activated by output 384, and rejection mechanism solenoid 190 may be set to be activated by output 386.

When Request for Receipt button 412 is pushed, a signal is sent to central processing unit 300 via input 369, which, in turn, causes a signal to be sent, via output 382, to receipt mechanism or printer 290 to print and issue a receipt to the customer.

Solenoid 150 of latching mechanism 100 is activated by a signal from output 390 after the inserted container has passed the tests in initial container receiving station 34.

Display panel 14*a* comprises a 16 character alphanumeric display which is controlled by central control unit 300 via output 392. Central control unit 300 may also provide additional visual control signals such as a Continue Turning Handle indicator via output 394, a Call manager indicator via output 395, a Container Not Empty indicator via output 396, a Not Beverage Can indicator indicating that the container is not a metal container via output 397, a Steel Can indicator indicating the container is a steel container via output 398 and an indicator indicating that the container is upside down via output 399.

Referring now again to FIGS. 25 and 29, as well as the flow charts shown in FIGS. 30–33, the operation of the apparatus is as follows. A container is inserted into container receiving station 34 of carousel 20, breaking the path of beam 40 from light source 38 shining onto photocell 42. A signal is then transmitted through an input 369 to central control unit 300 indicating that a container has been inserted. Sidewall detector 50 and steel detector 70 then send signals respectively via inputs 366 and 365 to central control unit 300 indicating whether the container has a metal sidewall and whether the sidewall is steel. If the container does not have a metal sidewall, Not Beverage Can LED is activated via output 397. If the container has a steel sidewall, the Steel Can LED is activated via output 398. At the same time, the Universal Product Code reader 270 sends a signal to central control unit 300 via input 375 indicating what sort of deposit, if any, has been collected and by whom.

After receiving the initial input signals from the respective detectors in initial receiving station 34, central control unit 300 activates can crusher motor 58 via output 380. A signal is also sent via output 390 to solenoid 150 to unlatch the carousel permitting rotation.

Central control unit 300, also, at this point, initiates several maintenance checks to insure that the equipment is functioning properly, as noted in the flow charts. Central control unit 300 checks if 8/10 second time period has elapsed since last insertion of a container. The purpose of 8/10 second time period is to prevent a rotation of the carrier until the previous can has been processed. If the 8/10 second time period has not expired, the apparatus waits for it to expire. Central control unit 300 then initializes a 45 second software timer. This timer circuit functions to monitor activity by the user, i.e., rotation of carousel 20, after insertion of an acceptable container in station 34. Central control unit 300 then checks, via input 370, whether the crusher motor is running or not, indicating the possibility of a jammed condition. If the crusher motor is running, the operation continues. If it is not running, all motors are shut off and Call Manager LED is activated via output 395. If a previous container has been processed through, a receipt is printed at this time. The crusher motor is deenergized and a crusher jammed message is displayed on panel 14*a*.

If the carousel is not rotated within 45 seconds, the machine is inactivated (i.e., the crusher motor is shut off). If the carousel is rotated, central control unit 300 checks for the presence of an aluminum can as the carousel is rotated.

At the same time, the turning of the carousel is monitored by central control unit 300 via optical limit switches 105 and 105A which send signals to central control unit 300 via inputs 371 and 372. If the carousel has passed the point of no can removal, solenoid 150 is deenergized and the operation is permitted to proceed.

It will be further noted from the flow charts of FIGS. 30–33 that other checks for errors are also made by the programming of central control unit 300 to insure proper functioning of the apparatus.

At the same time as these program and maintenance procedures are being carried out by central control unit 300, the container, initially inserted into container receiving station 34, is proceeding toward the crusher. The first rotation by the user moves the container to the weight and height checking position. If no subsequent containers are inserted by the user, a receipt is issued to the user, either in response to a pressing of the Request for Receipt button by the user or the elapse of 45 seconds, as previously discussed.

If another container is inserted and found acceptable, solenoid 150 is again activated, permitting further rotation of the carousel by the user. This results in the first container reaching the crushing station where the container drops into the jaws of the crusher as previously discussed.

While reference herein has been made to a microprocessor, it will be understood that other means, such as electromechanical devices, may be used to relay signals during use of the apparatus.

While the apparatus has been illustrated in a particularly preferred embodiment, it will be appreciated that the spirit and purpose of the invention is to provide a recycling apparatus capable of determining the presence of a container in a pocket in a rotatable carrier, the type of material in the sidewall of the container, and optionally, may include detection of the orientation of the container and reading a product code on the container wall; all prior to any movement or sound perceptable to the user; and then, if the container is acceptable according to the prior tests, further processing the container leading to the eventual crushing of the accepted container.

Minor modifications and alterations may thus be made which will not depart from the spirit of the invention which is to be limited only by the scope of the appended claims.

What is claimed is:

1. Apparatus for the receipt of recyclable containers, said apparatus being characterized by the analysis and initial acceptance or rejection of a container for recycling without mechanical movement apparent to the user which comprises:

(a) a manually operated rotatable carrier;

(b) a container receiving station associated with said carrier;

(c) detecting means coupled to said receiving station to determine the presence of a metallic container acceptable to said apparatus including early presence detection wherein the detection of the presence of metal in said receiving station prior to the rotation of said receiving station into a position permitting insertion provides a signal to said apparatus that the metal being detected is not metal which has followed the proper insertion sequence; and (d) means for subsequently permitting manual actuation of said rotatable carrier if said container comprises a material acceptable to said apparatus.

2. Apparatus for the receipt of recyclable containers, said apparatus being characterized by the analysis and initial acceptance or rejection of a container for recycling without mechanical movement apparent to the user which comprises:

(a) a manually operated rotatable carrier;

(b) a container receiving station associated with said carrier;

(c) UPC detection means provided adjacent said container receiving station for detecting a code or marking or symbology on a container inserted into said station;

(d) means associated with said UPC detection means for processing information regarding a deposit paid for said container including determining the sources to whom deposits were paid and accumulating subtotals of amounts paid out for containers from each of said sources;

(e) detecting means coupled to said receiving station to determine the presence of a container comprised of acceptable material to said apparatus; and (f) means for subsequently permitting manual actuation of said rotatable carrier if said container comprises a material acceptable to said apparatus.

3. Apparatus for the receipt of recyclable containers, said apparatus being characterized by the analysis and initial acceptance or rejection of a container for recycling without mechanical movement apparent to the user which comprises:

(a) a manually operated rotatable carrier;

(b) a container receiving station associated with said carrier;

(c) detecting means coupled to said receiving station to determine the presence of a container comprised of acceptable material to said apparatus and further including an eddy current detector means mounted adjacent said receiving station to analyze the end of the container adjacent the bottom of the receiving station for openings or discontinuous surfaces indicating the presence of a container inserted upside down; and (d) means for subsequently permitting manual actuation of said rotatable carrier if said container comprises a material acceptable to said apparatus.

* * * * *